US011181350B2

(12) United States Patent
McDevitt et al.

(10) Patent No.: US 11,181,350 B2
(45) Date of Patent: Nov. 23, 2021

(54) METHODS AND DEVICES FOR AMMUNITION UTILIZING A PARTICULATE OBTURATING MEDIUM

(71) Applicants: Jason P. McDevitt, Williamsburg, VA (US); James Y. Menefee, III, Macon, GA (US)

(72) Inventors: Jason P. McDevitt, Williamsburg, VA (US); James Y. Menefee, III, Macon, GA (US)

( * ) Notice: Subject to any disclaimer, the term of this patent is extended or adjusted under 35 U.S.C. 154(b) by 0 days.

(21) Appl. No.: 17/008,947

(22) Filed: Sep. 1, 2020

(65) Prior Publication Data

US 2021/0140747 A1 May 13, 2021

Related U.S. Application Data

(63) Continuation-in-part of application No. 16/854,038, filed on Apr. 21, 2020, now abandoned.

(60) Provisional application No. 62/836,944, filed on Apr. 22, 2019.

(51) Int. Cl.

| | |
|---|---|
| ***F42B 7/08*** | (2006.01) |
| ***F42B 7/04*** | (2006.01) |
| ***F42B 33/02*** | (2006.01) |

(52) U.S. Cl.

CPC ..... *F42B 7/08* (2013.01); *F42B 7/04* (2013.01); *F42B 33/0207* (2013.01)

(58) Field of Classification Search

CPC ..... F42B 7/00; F42B 7/02; F42B 7/04; F42B 7/06; F42B 7/08; F42B 7/10; F42B 33/00; F42B 33/02; F42B 33/0207

USPC ..... 102/430–463, 532

See application file for complete search history.

(56) References Cited

U.S. PATENT DOCUMENTS

| | | | | | |
|---|---|---|---|---|---|
| 1,358,279 | A | * | 11/1920 | Bond | F42B 7/08 106/137.2 |
| 1,872,107 | A | * | 8/1932 | Bond | F42B 7/08 106/164.12 |
| 2,759,852 | A | * | 8/1956 | King | F42B 7/08 428/372 |
| 3,090,309 | A | * | 5/1963 | Burns, Jr. | F42B 7/12 102/444 |
| 3,672,301 | A | * | 6/1972 | Abbott | F42B 8/04 102/530 |
| 3,804,019 | A | * | 4/1974 | Hurley | F42B 7/08 102/448 |
| 4,162,645 | A | * | 7/1979 | Abbott | F42B 8/04 86/23 |
| 4,686,904 | A | * | 8/1987 | Stafford | F42B 7/04 102/439 |
| 7,814,820 | B2 | | 10/2010 | Menefee | |

(Continued)

FOREIGN PATENT DOCUMENTS

| | | | | |
|---|---|---|---|---|
| GB | 2496180 B | * | 4/2016 | F42B 5/30 |

*Primary Examiner* — James S Bergin
(74) *Attorney, Agent, or Firm* — Jason P. McDevitt

(57) ABSTRACT

Herein we describe cartridges, including for shotgun shells, utilizing a particulate obturating medium to provide a gas seal. The obturating medium comprises particles having an average particle size greater than 212 microns, and an average specific gravity greater than 1.1. Such cartridges are particularly useful as shotshell cartridges used as blanks, less lethal loads, hunting loads, target loads, and barrel-cleaning loads. Methods for loading and use are described, as well as different particulate obturating media.

22 Claims, 6 Drawing Sheets

(56) References Cited

U.S. PATENT DOCUMENTS

| | | | | |
|---|---|---|---|---|
| 8,276,519 | B2 | 10/2012 | Menefee | |
| 10,139,206 | B2 * | 11/2018 | Havens | C08L 67/04 |
| 10,393,486 | B2 * | 8/2019 | Havens | C08J 5/00 |
| 10,480,914 | B2 * | 11/2019 | Havens | F42B 33/12 |

* cited by examiner

METHODS AND DEVICES FOR AMMUNITION UTILIZING A PARTICULATE OBTURATING MEDIUM

CROSS-REFERENCE TO RELATED APPLICATIONS

The present application is a continuation-in-part application of U.S. patent application Ser. No. 16/854,038, filed Apr. 21, 2020, which claims the benefit of U.S. Provisional Patent Application No. 62/836,944, filed Apr. 22, 2019, the entire disclosures of which are incorporated by reference herein.

STATEMENT REGARDING FEDERALLY SPONSORED RESEARCH OR DEVELOPMENT

Not applicable

BACKGROUND

Field of the Invention

The field of the invention relates to cartridges for use in projectile-launching devices, including ammunition cartridges, flare cartridges, pyrotechnics, and fire suppressants, as well as methods for their use and manufacture.

Description of the Related Art

Usually, a cartridge such as a firearm shotshell is manufactured by inserting an ignition primer into an empty cartridge, also called a "case" or "casing" or "hull". A measured or selected amount of propellant is inserted or poured into the cartridge. The propellant has a portion thereof contiguous with the primer. A wad, manufactured from a fixed size of material such as cardboard (some cardboard wads are called "nitro cards"), cork, plastic and the like, is inserted into the cartridge. One portion of the wadding thereof is contiguous with the propellant.

A projectile, slug or slugs, pellets, spheres, cubes, etc. in any geometric shape may be inserted into the cartridge. The projectile(s) may, if desired, be manufactured from lead, steel or other suitable materials, including shot materials approved in the United States by the Sporting Arms and Ammunition Manufacturers' Institute (SAAMI). The projectile(s) has one portion thereof contiguous with the wadding material. The cartridge is typically closed by pressure-fitting a portion of the cartridge around the projectile(s). The pressure fitting may be accomplished by rolling or folding the cartridge mouth onto the projectile, then crimping the distal edge of the cartridge around the projectile(s). A six or eight point fold or "star" crimp may typically be used in cartridges that contain multiple projectiles ("shot"). An overshot card of some material may be used with a roll crimp to contain shot loads. The loaded ammunition is ready to be used or packaged with other loaded ammunition.

Typically, ammunition is fired from a firearm by first placing the ammunition into the breach of the firearm. Examples of firearms are rifles, pistols, shotguns, muskets and military-type weapons like artillery pieces. In firing the ammunition, a mechanical force is applied against the ignition primer, causing an explosion. The resulting action ignites the propellant, causing expanding hot gas to propel the projectile(s) laterally along the bore of the firearm.

In practice, the actual firing sequence includes the burning propellant gases, wadding, and projectile(s) entering a forcing cone before entering the bore of the firearm. The forcing cone is an area between the end of the cartridges in the breach and the bore of the firearm. The large end of the forcing cone is contiguous with the breach and the smaller end is contiguous with the bore. The forcing cone compresses the hot gas and wadding, thereby increasing the force present on the projectile(s).

If the wadding is not appropriately fitted in the cartridge hull, it may not obturate or seal the compressed hot gas. This results in a blow-by effect of the hot gas and possible loss of pressure and projectile speed, causing a decrease in the performance of the firearm.

Plastic wads, typically made from polyethylene, generally provide outstanding gas sealing performance, while also providing other benefits. One deficiency is that the wads are sized for a particular bore. A 16 gauge wad will not work in a 12 gauge shotgun. Expensive injection molds are therefore required for each different diameter wad.

Menefee describes wad-less cartridges, and methods for their manufacture, in U.S. Pat. Nos. 8,276,519 and 7,814,820. In U.S. Pat. No. 8,276,519, Menefee describes a suitable obturating medium as one in with no "lower limit of suitable particle sizes that work", and an "approximate upper limit of useful particle sizes of 0.005 inch to about 0.008 inch for particles that function with a good obturating effect". Accordingly, Menefee describes an upper limit of obturating effectiveness of 203 microns.

These wad-less mixtures can perform well. However, they share, and even exacerbate, another deficiency of conventional plastic wads. That is, they increase plastic and microplastic pollution.

Shotguns are one of the most widely produced firearms worldwide. For example, the number of new shotguns manufactured in the United States was close to one million in 2011. Moreover, the annual production of shotgun shells is in the billions. Every shotgun shell that is fired will discharge a wad (i.e., a "spent" wad) at a substantial distance from the sportsman. This distance prevents facile recovery and the ejected wad subsequently becomes pollution. Typically, the wad is composed of plastic that does not biodegrade, meaning the pollution is long-lasting.

The effect of non-biodegradable plastic debris is significant. Abandoned shotgun wads can present safety, nuisance, and environmental problems on land and in freshwater, estuarine, and marine waters. When a waterfowl hunter fires a shotgun armed with a shell containing a non-biodegradable plastic wad, the wad is shot out of the gun and often flies into nearby water. The quantity of abandoned shotgun wads in the nation's waters is unknown; however, a shotgun wad is abandoned with every shot fired. Target shooters (e.g., skeet, trap) often fire many shots in rapid succession, leaving a slew of plastic wads. Due to the range of shotguns, there is no practical way for sportsmen to recover spent shotgun wads.

Abandoned wads enter the food chain as non-biodegradable plastic debris. Plastic wads are reported as one of the most common debris items collected during beach cleanups (NOAA. 2012. Guidebook to community beach cleanups). The buoyancy of many plastics causes the debris to float; therefore, plastic wads that do not wash ashore will float on the water's surface. The floating wads can be mistaken for food by waterfowl and other marine species. For example, wads have been found in the stomach contents of ocean-foraging birds including the albatross (The Conservation Report. 2009). The consumption of plastic leads to reduced fitness and delayed mortalities of aquatic species.

Abandoned wads also damage sensitive habitats. Over time, non-degradable plastic wads can break apart, causing massive amounts of non-degradable microplastics to enter the aquatic ecosystem. Currents can deposit the floating wads on distant river banks and coasts, thereby impacting all marine habitats, even habitats where hunting is prohibited. Furthermore, non-degradable plastic components can remain largely intact, even after spending years afloat, before fracturing into smaller microplastics. The microplastics can adsorb organic toxins and do not readily break down into compounds that can be assimilated into the natural carbon cycle. Unfortunately, when used as intended, the plastic obturating medium described in U.S. Pat. Nos. 8,276,519 and 7,814,820 effectively provides an efficient means to disperse microplastics in the environment.

Other deficiencies of a wad-less cartridge, as known in the prior art, can include increased difficulty in loading the cartridge, particularly for factory automated loads, including messy or slow or incomplete loading, as well as user annoyance when microplastic particles blow around the user's face after the projectile is fired.

Accordingly, there remains a need for a cartridge that: does not rely on a conventional plastic wad for gas sealing and does not contribute to plastic pollution concerns, but still loads and performs well.

SUMMARY

The present disclosure provides an improved method and apparatus of manufacturing and using cartridges, such as shotshell ammunition, which do not rely primarily on a wad for gas sealing but instead rely on an obturating medium of small particles, which present visually as a powder or granular mix. Traditionally, ammunition has utilized a solid wad or wads disposed between the projectile and the propellant. In the present disclosure, a particulate obturating medium is utilized between the projectile and the propellant, wherein the obturating medium comprises a suitable amount of a suitable particulate material, wherein the obturating medium comprises particles having an average specific gravity greater than 1.1, and wherein said particles have an average size (in a cartridge prior to firing) greater than 212 microns.

Suitable obturating media can including any type of particles, although some are better suited than others. In particular, particles comprising organic polymers, inorganic compounds, and/or combinations thereof can perform well as obturating media in accordance with the methods and devices described herein. Biodegradable plastics can be used in accordance with the methods and devices described herein. Other organic polymers can also be utilized. For example, naturally occurring organic obturating media comprising a combination of three different types of organic polymers (cellulose, hemicellulose, and lignin) can be quite effective. For example, granulated corn cob hulls and granulated nut shells can make very good obturating media for shotshells.

Obturating media comprising inorganic particles, or particles containing substantially inorganic compounds, can also be quite effective in providing good shotshell performance. Suitable such obturating media include glass beads or crushed glass, aluminum oxide, crushed seashells (e.g., oyster), and eggshells.

It is important that the obturating media not scratch the bore of a shotgun, and thus particle compositions having hardness greater than 6.5 on the Mohs scale (including many inorganic particle media) are disfavored for most guns.

In some embodiments wherein the cartridge is a shotshell, the average size of the particles comprising the particulate obturating medium drops by at least a factor of two in the immediate aftermath of the cartridge being fired (i.e., by the time the particles leave the barrel of the shotgun). This feature can have numerous advantages, facilitating loading and/or gas sealing, and improving shotshell performance by creating an in situ buffering effect. The high pressures obtained when a shotshell is fired, combined with the presence of the shotgun bore and shot projectiles, means that the particles in the obturating medium can be broken apart into smaller particles. This does not always happen, particularly when tough obturating media is used.

It is preferable that the particulate obturating medium comprises irregular particle sizes, rather than spherical particles. Hard, spherical particles generally do not provide acceptable gas sealing.

In typical embodiments, the obturating medium comprises particles having an average size between 212 microns and 1,680 microns. At least 75% by weight of the particulate obturating medium is retained on a 212 micron sieve, preferably at least 90 percent. In many embodiments, at least 90% by weight of the particulate obturating medium is retained on a 400 micron filter. In certain embodiments, at least 90% by weight of the particulate obturating medium is retained on an 840 micron filter, and passes through a 1,190 micron filter. Particle sizes lower than 212 microns tend to flow poorly, and thus complicate loading, particularly automated, high-speed, factory loading. Moreover, for loads where the same polymer formulation used as the obturating medium is also used as a buffer, average particle sizes less than 212 microns tend to produce loads with overly high pressures. In general, larger particle sizes tend to have inferior sealing ability relative to smaller particle sizes of the same composition. That said, obturating media of sizes larger than, for example, 1,100 microns, can provide good gas sealing in a shotshell provided enough of the material is used. In other words, larger particle sizes may require more obturating media to get the same sealing properties. Particles that are both large and hard (e.g., Shore D hardness values above 80), can easily damage plastic shotgun hulls when fired.

In some shotshell embodiments, the obturating medium and projectile shot are pre-mixed prior to crimping.

In some embodiments, the particulate obturating medium is contained within a flexible solid such as a fabric or paper.

In other embodiments, the obturating medium is added after the propellant powder, and the projectile shot is added on top of the obturating medium without further mixing. The shotshell can then be crimped. Typically, a compression step is added prior to crimping. In such embodiments, it is crucial that there is no significant migration between the various layers (i.e., propellant powder, obturating medium, shot). We have found that this migration readily occurs if the particles of the obturating medium easily fit into the void spaces of the shot layer. Accordingly, for such "3-piece" loads in which there is no intentional pre-mixing of the obturating medium and shot projectiles, it is important that relatively large particles are used in the obturating medium, preferably particles that won't easily break into smaller pieces during, for example, routine transport of the shotshells.

As contemplated herein, the average specific gravity of the particles comprising the obturating medium is greater than 1.1. This does not mean the density of the obturating medium, as packed in a shotshell, must be greater than 1.1 g/cm$^3$. The bulk density of the obturating medium can be substantially lower than 1.1 g/cm$^3$, and in some cases a lower bulk density is advantageous because it means less weight is added to the shotshell. A specific gravity of greater than 1.1 is important because a hunter often shoots with the gun pointing substantially above horizontal, e.g., at a 45 degree angle above horizontal when shooting at a bird in flight. When less dense particles used; for example, when polyethylene is used, particles can blow back into the face of a shooter or other nearby shooters, which can be annoying and can disrupt ongoing shooting. When the average specific gravity of the particles in the particulate obturating medium is greater than 1.1, and average particle size is greater than 212 microns as described herein, the likelihood of significant disruption from airborne particles is substantially reduced, and in some cases becomes almost negligible.

When the propellant is activated and burns in the chamber of a firearm, the gases created in the chamber propel the projectile(s) and obturating medium forward out of the cartridge and throat of the barrel chamber and into the forcing cone. The expanding gases propel the entire ejecta forward, compressing the entire ejecta to the conical shape of the forcing cone and barrel diameter. The obturating medium also compresses to the conical shape of the forcing cone maintaining the gas seal about the end of the projectile(s) in the bore of the firearm. The structural components of the compressed obturating medium press outwardly against the sides of the forcing cone and the sides of the bore, creating a load-bearing wall. The obturating medium acts not only as a superior seal, but also insulates the projectile(s) from the intense heat of the powder combustion, and appears unaffected by severely cold temperatures. The obturating medium can also provide a cushion effect on the projectile(s), thereby reducing deformation.

While one embodiment of this disclosure is provided by a shotshell cartridge, as illustrated in the discussion and figures in detail, the methods of this disclosure are generally applicable to any type of cartridge that is intended to launch projectiles. For example, the methods and components disclosed here can be used to provide cartridges that include, but are not limited to: ammunition cartridges such as shotshell, rifle, or pistol cartridges, including blanks; flare cartridges; grenade launcher cartridges; smoke flare cartridges; signaling device cartridges; fire suppressant cartridges; chemical munitions cartridges; distraction device cartridges such as flash-bang cartridges; pyrotechnic launching device cartridges; cartridges designed to be fired for cleaning the barrel of a gun or other launcher; and the like. Moreover, the cartridges of this disclosure are not limited as to any type of primer or primer composition, propellant, or projectile, as understood by one of ordinary skill. By way of example, the methods and components disclosed here can be applied in cartridges that use center fire or rim fire primer configurations.

Thus, according to one aspect, the present disclosure provides a cartridge comprising: a) a cartridge case having a proximal end and a distal end, further comprising a primer situated at the proximal end; b) a propellant, a portion of which is contiguous with the primer; c) an obturating medium, a portion of which is typically contiguous with the propellant (although there may be a spacer component between the propellant and the obturating medium); wherein the obturating medium comprises one or more granular formulations, wherein said obturating medium comprises particles having an average size exceeding 212 microns, and wherein said particles have an average specific gravity greater than 1.1. Typically, the obturating medium occupies at least 5 mm of the length of a loaded cartridge. In other embodiments, the amount of obturating medium is sufficient to occupy at least 6 mm, or at least 7 mm, or at least 8 mm, or at least 9 mm, or at least 10 mm in length of the loaded cartridge.

The minimum weight of particulate obturating medium required to ensure proper gas sealing is dependent on the size of the particles, the type of particles, the size of the cartridge, and other load-specific variables. In typical embodiments in which the particulate obturating medium is not contained within a separate container, the amount of particulate obturating medium in a shotshell with proper gas sealing is at least 10 grains when used with a 12 gauge shotshell, or at least 20 grains, or at least 30 grains, or at least 40 grains, or at least 50 grains, or at least 60 grains obturating medium. For smaller bore cartridges, the amount of obturating medium can be far less. For example, we routinely load .410 cartridges with between 12 and 15 grains of ground walnut shell obturating media. For corn cob media, even smaller weights of obturating media can be used and still obtain a good gas seal with a .410 cartridge. The key is not so much the weight of the particulate obturating media, but whether it occupies enough length within the cartridge to provide a good gas seal.

In typical embodiments, the particles of the particulate obturation medium nearest to the proximal end of the cartridge case are within 5 mm of the most distal part of the propellant, or within 3 mm of the most distal part of the propellant, or within 2 mm or the most distal part of the propellant. In many such embodiments, the most proximal particles of the particulate obturating medium are contiguous with the propellant. In other embodiments, the most proximal particles of the particulate obturating medium are separated from the propellant by a thin spacer ("spacer wad") wherein the spacer wad, in and of itself, does not provide a gas seal sufficient to sustain standard pressure and velocity in a shotshell.

In typical embodiments, the cartridge contains a projectile, which can include a powdered projectile, and can also include typical projectiles for shotgun ammunition such as birdshot, buckshot, or a slug. In some embodiments, the obturating medium also serves as a projectile. In some embodiments, the cartridge additionally contains a pre-formed wad, such as a fiber wad, a felt wad, a cork wad, a nitro card, a shot wad such as a shot cup, a paper wad, a cardboard wad, an overshot wad, or any other type of wad. In typical such embodiments, any such added pre-formed wad would be biodegradable. In typical such embodiments, the pre-formed wad would not serve as the primary gas seal, but instead would primarily provide one of the other typical functions of a wad, such as protecting a gun barrel, separating components within the cartridge, or providing a hard barrier to reduce particle flow. Typically, the particulate obturating medium layer is immediately adjacent to the propellant layer. When they are separated (for example, by a solid material such as a wad), the separation is typically less than 10 mm, and more typically less than 5 mm, which is less than the minimum width of a prior art wad sufficient to maintain a good gas seal. In some embodiments, a wad providing at least a spacing function is incorporated between the propellant layer and the particulate obturating medium. In some embodiments, a wad providing at least a spacer function is incorporated between the particulate obturating medium and the projectile component, thereby separating the particulate obturating medium and the projectile component, and again, the resulting separation is typically less than 10 mm, and more typically less than 5 mm.

In some embodiments, the cartridge contains a projectile along with buffering agent. In accordance with another aspect of this disclosure, there is provided a cartridge comprising: a) a cartridge case having a proximal end and a distal end, and comprising a primer situated at the proximal end; b) a propellant, a portion of which is contiguous with the primer; c) an obturating medium, a portion of which can be contiguous with the propellant; wherein the obturating medium comprises a particulate formulation; wherein the particles in the particulate formulation have an average size exceeding 212 microns, and an average specific gravity greater than 1.1; and d) at least one projectile, a portion of which can be contiguous with the obturating medium (or there can be a spacer component between the obturating medium and the projectile); wherein the distal end of the cartridge is crimped closed or partially crimped about the at least one projectile. In one such embodiment, the cartridge is a shotgun shell. In another embodiment, the projectile is at least one projectile selected from the group consisting of birdshot, buckshot, and slug projectiles. In another embodiment, the projectile consists of granular or powder particles.

In some embodiments, methods and devices for blank loads are described.

In some embodiments, methods and devices for a shotshell load that cleans a shotgun bore are described.

In some embodiments, a method of firing a cartridge is described.

In other embodiments, a method of manufacturing or loading a cartridge is described.

In some embodiments, a shotshell loaded according to the methods described herein has a particularly pleasant smell after being fired.

In other embodiments, an obturating medium is described. One aspect of the disclosure is that high-performing loads, substantially free of conventional plastics, can be made for any different sized gun without necessitating use of expensive molds (e.g., injection molds) for each different size. The obturating medium is thus quite useful for relatively uncommon bore sizes, for which traditional factory-loaded cartridges can be more expensive and harder to obtain. It allows a company, for example, to develop a complete line of shotgun shells without needing many sizes of pre-formed wads. It is also convenient for reloaders.

BRIEF DESCRIPTION OF THE DRAWINGS

The summary above, and the following detailed description, will be better understood in view of the drawings which depict details of preferred embodiments.

DETAILED DESCRIPTION

Figure 1:
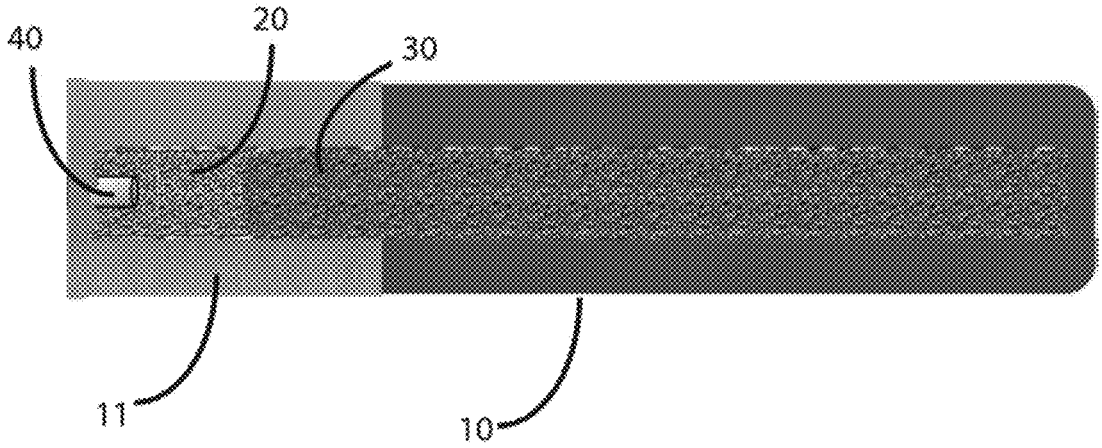
FIG. 1 shows a cutaway perspective view of one embodiment of a shotgun shell loaded with a particulate obturating medium comprising a biodegradable polymer formulation as described herein.

The present disclosure is directed to cartridges, including shotshell cartridges, utilizing a particulate obturating medium to provide a gas seal, methods for their manufacture and loading, and methods for their use. The key feature of the disclosure is an obturating medium comprised of particles, wherein the particles have an average particle size exceeding 212 microns and an average specific gravity exceeding 1.1, and wherein the obturating medium is loaded in an amount sufficient to fill 5 mm or more along the length of the cartridge, typically 6 mm or more, in order to provide a satisfactory gas seal.

The term "wad" refers to a pre-formed component of a shotgun shell that is used to separate the shot from the powder, and/or to provide a seal that allows pressure to build and then prevents gas from blowing through the shot rather than propelling the shot out of the shotgun, and/or contain the shotgun shot, and/or provide cushioning, and/or fill space in the shell. Commercial wads often consist of three parts: the powder wad, the cushion, and the shot cup, which may be in separate pieces or can be incorporated into a single component. The wad is stored within a shotgun cartridge. As the context allows, the term "cartridge" can refer to the finished manufactured article, such as a completed ammunition cartridge; however, in some contexts, the term "cartridge" may refer to the empty "casing" or "case" that is charged according to this disclosure to provide the finished article, as apparent from its particular use.

The particles used in the particulate obturating medium are rarely spherical and possessive of a single diameter. Instead, they are typically irregularly shaped. As used herein, the term "size" of a particle refers to the largest sieve filter on which a particle is retained. For example, a particle having a size of 250 microns is a particle that is typically retained on a 60 mesh filter (U.S. mesh size, where the mesh size is the number of threads per square inch in each direction) having square grid hole sizes of 250 μm, which would also be retained on smaller mesh grids (i.e., higher mesh numbers), but passes through larger mesh grids such as a 50 mesh filter having openings of 297 μm. Not all particles in an obturating medium will have the same size. Typically a range of sizes is utilized. For example, a 12/20 walnut medium refers to an obturating medium in which most of the particles pass through a number 12 mesh screen (1680 μm), and most of the particles are retained on a 20 mesh screen (841 μm). Similarly, a 20/30 corn cob medium means that most particles pass through a 20 mesh screen, but are retained on a 30 mesh screen.

As used herein to refer to particles sizes in a particulate obturating medium, the term "average" refers to the size of the opening in a mesh filter that retains half of the mass of an obturating medium. For example, an obturating medium having an average size of 1,000 μm would pass half of its mass through a number 18 mesh screen (1000 micron screen), while the other half of the mass would be retained on the screen.

FIG. 1 is a schematic cutaway diagram showing a shotgun shell according to one embodiment of the disclosure as described herein. The cartridge case 10 (cutaway in the diagram to reveal the contents inside the casing), here shown to include a brass or metal-plated head 11, contains a powder charge or propellant 20 adjacent to a particulate obturating medium 30. Upon firing, the primer 40 ignites the powder charge 20, which propels the particulate obturating medium 30. In this representative embodiment, the casing 10 includes a brass head 11. A base wad of the types known in the art can be present as well (or can be built into the hull), but is not shown in the diagram. The particulate obturating medium forms a gas seal upon firing by flowing to seal gaps through which propellant gases could otherwise escape. The particulate obturating medium travels downfield. This embodiment is an example of a blank shotgun shell. It can also be used to clean the barrel of a gun. Optional additional components can improve gun-cleaning performance, including waxed or lubricated particles or wads or other solid objects.

Figure 2:
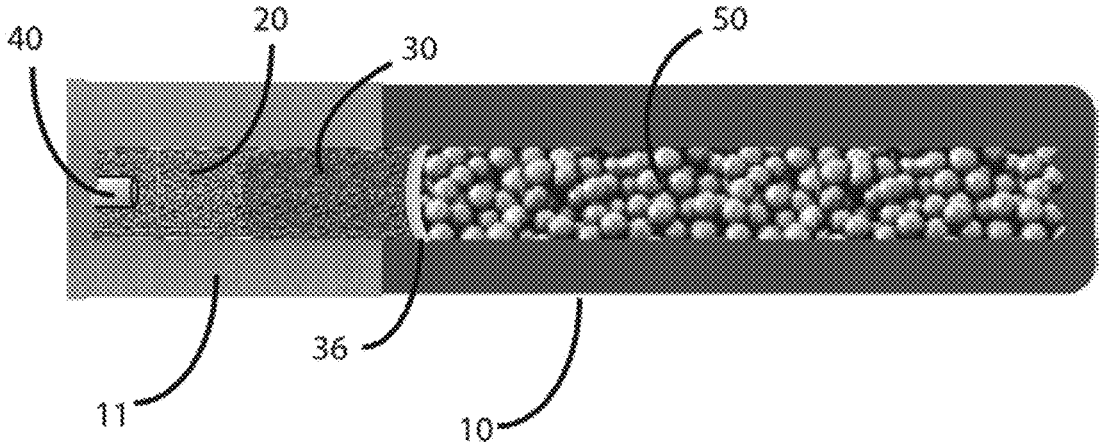
FIG. 2 shows a cutaway perspective view of one embodiment of a shotgun shell loaded with a particulate obturating medium comprising a biodegradable polymer formulation as described herein. This embodiment includes an additional pre-formed wad and shot.

FIG. 2 is a schematic cutaway diagram showing a shotgun shell according to one embodiment of the disclosure as described herein. The cartridge case 10 (cutaway in the diagram to reveal the contents inside the casing), here shown to include a brass or metal-plated head 11, contains a powder charge or propellant 20 adjacent to a particulate obturating medium 30. A pre-formed wad 36 is loaded on top of the particulate obturating medium, and shot projectile 50 is loaded after and adjacent to wad 36. Upon firing, the primer 40 ignites the powder charge 20, which propels the particulate obturating medium 30, wad 36, and shot 50 through the barrel of a shotgun. In this representative embodiment, the casing 10 includes a brass or metal-plated head 11. The particulate obturating medium forms a gas seal upon firing by flowing to seal gaps through which propellant gases could otherwise escape. The particulate obturating medium, wad, and shot all travel downfield. The cartridge case would typically be crimped using any type of crimp known in the art. The crimp is not shown in this schematic figure.

Figure 3:
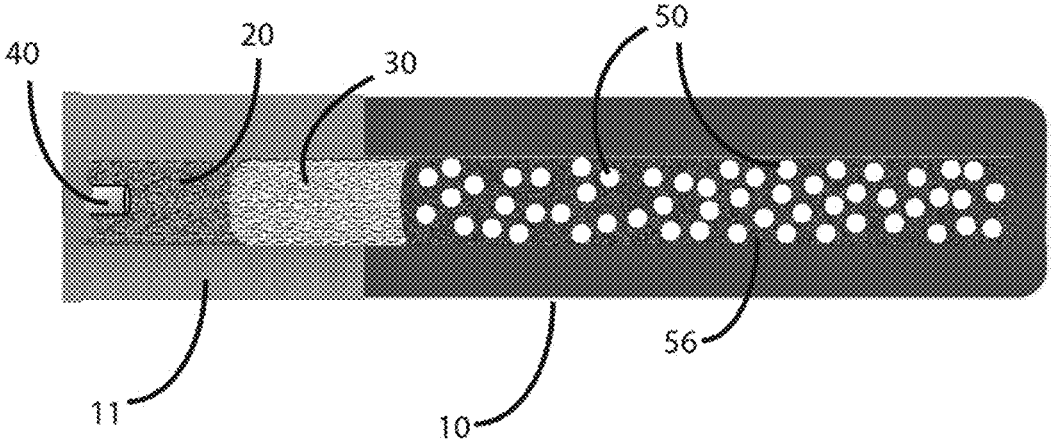
FIG. 3 shows a cutaway perspective view of one embodiment of a shotgun shell loaded with a particulate obturating medium as described herein. This embodiment includes buffered shot.

FIG. 3 is a schematic cutaway diagram showing a shotgun shell according to one embodiment of the disclosure as described herein. The cartridge case 10 (cutaway in the diagram to reveal the contents inside the casing), here shown to include a brass or metal-plated head 11, contains a powder charge or propellant 20 adjacent to a particulate obturating medium 30. After adding the particulate obturating medium during loading, a mixture of buffer 56 and projectile shot 50 is added, either pre-mixed or separately with subsequent mixing. In some embodiments, the buffer 56 can be the same material as the particulate obturating medium 30. Upon firing, the primer 40 ignites the powder charge 20, which propels the particulate obturating medium 30, buffer 56, and shot 50 through the barrel of a shotgun. The particulate obturating medium forms a gas seal upon firing by flowing to seal gaps through which propellant gases could otherwise escape. The particulate obturating medium, buffer, and shot all travel downfield. The cartridge case is typically be crimped using any type of crimp known in the art. The crimp is not shown in this schematic figure.

In one aspect, a hull is inserted into a cup-shaped metal head (typically made from brass or plated metal) by any means known in the art for making ammunition to provide a cartridge. The primer 40 provides the explosive charge to the cartridge 10. In order to load the cartridge, a selectively measured amount of appropriate propellant 20 is poured into the open end of the cartridge 10. The measured amount of propellant 20 may vary depending on the type of cartridge 10 that is being loaded. For example, the selected amount of propellant 20 for loading a 12-gauge shotgun hull is more in volume, and can have different types of burning characteristics, than is required for loading a 410-gauge shotgun hull. A selectively measured amount of particulate obturating medium 30 is poured into the open end of cartridge 10 over the propellant 20. Subsequently, a selectively measured amount of buffer particles 56 and projectile shot 50 are poured into the open end of the cartridge 10 over the particulate obturating medium 30. A solid projectile such as a slug may be used instead of shot as a projectile. The measured amount of particulate obturating medium 30, buffer particles 56, or shot projectiles 50 can vary depending on the type of cartridge 10 that is being loaded or the desired characteristics of the load. During loading, a packing tool, including but not limited to a metal rod, can be used to press air out of the particles in the cartridge. In some embodiments, the particulate obturating medium or buffer particles are loaded in stages along with packing to avoid overflow or spilling. The open end of the casing is crimped with a roll crimp, star crimp, or any other crimping style known in the art. Typically a six-point or eight-point seal is used. Crimping is used to contain the load within the confines of the shell, assist the powder burn to create adequate combustion pressure during the early stages by reducing premature movement, provide predictable release of the projectile as pressure builds, and protect the contents of the cartridge from contamination.

Note that FIGS. 1-3 are schematic drawings that do not depict all features or embodiments that are contemplated. For example, the amount of particulate obturating medium can be more or less than is shown, as is the case with the projectiles and propellant. In some cases, the obturating medium is not immediately adjacent to the propellant; for example, a nitro card or other wads or spacers can be used between the obturating medium and propellant. In preferred such embodiments, the spacer material between the propellant and the particulate obturating medium, such as a spacer wad, is insufficient in and of itself to form a suitably good gas seal, and the distance between at least some particles of the particulate obturating medium and the propellant is 5 mm or less.

The key feature of the present disclosure is the use of a particulate obturating medium to provide the gas sealing function typically provided by pre-formed wads as described above, whether as separate gas seals or as one-piece wads. Many wads made from biodegradable materials such as paper, cardboard, felt, fiber, or cork, have relatively poor gas sealing performance compared to conventional plastic wads. In contrast, the obturating media of the present disclosure provide outstanding gas seals when used according to the methods of the disclosure.

This ability of a particulate obturating medium to provide a good gas seal is generally surprising to most people, particularly given that one of the main flaws of many traditional gas sealing wads is that they can pinhole, crack, or otherwise generate small fissures that ruin the gas seal.

The amount of obturating medium required to form a good gas seal when the cartridge is fired is a function of the material composition of the obturating medium, the size and shape of the particles, the projectile, the amount and composition of the propellant that is used, and the diameter of the barrel of the gun or launcher. For a 12 gauge shotgun cartridge, typically at least 2 grams obturating medium is used, although higher amounts of obturating medium can be used, including and up to filling up the remaining volume of the hull, and the amount that is used depends on the composition of the obturating medium. For smaller bored shotguns, the requisite amount of obturating medium drops by a factor proportional to the square of the relative bore sizes.

Irrespective of the weight of the obturating medium, or the diameter of a gun, or even the composition of the obturating medium, one factor that is consistent is the minimum length of the obturating medium band within a cartridge that is necessary to produce a good gas seal.

In all embodiments, the length (as measured from the most proximal particles to the most distal particles), as loaded, of the obturating medium, in any sized hull, is at least 5 mm, preferably at least 6 mm. In other words, a sufficient amount of obturating medium must be added such that it fills up at least 5 mm of the length of a cartridge, noting that cartridges are typically cylindrical or tapered cylindrical in shape. This can also be phrased as a sufficient amount of obturating medium must be added such that it fills up at least 5 mm of the linear volume of the cartridge. More technically, a sufficient volume of particulate obturating medium is added to fill a percentage of the cartridge equal to 5 mm divided by the interior length of the loaded cartridge when subjected to the pressure of a loaded cartridge. This provides for a minimum average separation of at least 5 mm between the propellant and any projectile. In some embodiments, a volume of obturating medium is added sufficient to occupy a volume equal to the product of 5 mm and the average cross-dimensional area of the hull, or the product of 6 mm and the average cross-dimensional area of the hull, or the product of 7 mm and the average cross-dimensional area of the hull, or greater volumes. If the amount of obturating medium in the cartridge is an amount insufficient to occupy at least 5 mm of the length of the loaded and crimped cartridge, then the obturating medium will not itself provide a good gas seal. In typical embodiments with a 12 gauge shell, at least 1.5 grams of obturating medium is needed in order to form a good gas seal, and typically more will be used.

Relatively speaking, gas sealing performance generally improves with: reduced size of the particles in the obturating medium, increased compressibility of the particles, reduced flowability of the particles, higher angle of repose of the particles, and increased density of the particles.

Obviously, those are a lot of variables, and the amount of obturating medium necessary to get an adequate gas seal depends greatly on the composition of the obturating medium. There are many tradeoffs. For example, a particular obturating medium with average size of 400 microns might be able to provide an adequate gas seal for a given load when taking up 7 mm of the length of a loaded shell, but in an otherwise equivalent load using obturating medium of the same material but having an average size of 1,000 microns, a significantly greater volume of obturating medium may be required in order to get an adequate gas seal The methods and articles of the disclosure require that the particulate obturating medium comprises particles that have the form of a granular solid, including a granular powder. If the average particle size is too large, then the sealing capacity can be compromised. If the average particle size is too small, then the ease of loading is diminished, particularly for automated loading machines, and chamber pressure may be too high upon firing. Smaller particles tend to have a higher ratio of surface area to volume, and are relatively more susceptible to absorbing moisture, which can impede flow. Caking can occur, dispensing volumes can be erratic, and dust can be messy and hazardous to health. Moreover, after firing a shotgun loaded with a cartridge comprising a particulate obturating medium with average particle size less than 212 microns, the smaller particles (i.e., less than 212 micron) are more likely to annoy a shooter by blowing back into the shooter's face. Moreover, smaller particles generally provide tighter packing, which means that more material by weight is used, increasing load pressure and increasing load cost. Accordingly, as described herein, the obturating medium comprises particles having an average size exceeding 212 microns. In some preferred embodiments, the obturating medium has an average size exceeding 250 μm, or 300 μm, or 400 μm, or 500 μm, or 600 μm, or 700 μm, or 800 μm, or 840 μm, or 900 μm, or 1,000 μm, or 1,100 μm, or 1,200 μm, or 1,250 μm, or 1,300 μm, or 1,400 μm, or 1,500 μm, or 1,600 μm. The upper limit depends on the material. Since some materials useful as obturating media fracture substantially upon firing (e.g., eggshells), the upper limit of average particle size can be quite large, as smaller-sized particles needed to form a good gas seal are produced in situ upon firing. In other embodiments, at least 80%, or at least 90%, or at least 95%, or at least 97% by weight of the obturating medium is retained on a filter having a mesh size of 250 μm, or 300 μm, or 400 μm, or 500 μm, or 600 μm, or 700 μm, or 800 μm, or 840 μm, or 900 μm, or 1,000 μm, or 1,100 μm, or 1,200 μm, or 1,250 μm, or 1,300 μm, or 1,400 μm, or 1,500 μm, or 1,600 μm.

Moreover, the upper limit of acceptable average particle size in the obturating medium depends on the variables of the load, and particularly on the linear volume of the cartridge occupied by the obturating medium. A layer of obturating medium that is 20 mm in length can utilize higher average particle sizes than one that is 10 mm thick while still obtaining a good gas seal. For most obturating media, for most shotshell loads, the upper limit on acceptable average particle size of the obturating medium will be less than 3,000 microns, typically less than 2,500 microns, or less than or 2,400 μm, or less than 2,300 μm, or less than 2,200 μm, or less than 2,100 μm, or less than 2,000 μm, or less than 1,900 μm, or less than or 1,800 μm, or less than 1,680 μm, or less than 1,600 μm, or less than 1,500 μm, or less than 1,400 μm depending on the composition of the obturating medium and other characteristics of the load.

In some embodiments, at least 85%, or 90%, or 95%, or 97% by weight of the obturating medium passes through a U.S. mesh size 10 filter, and is retained on a U.S. mesh size 60 filter. In some embodiments, at least 85%, or 90%, or 95%, or 97% by weight of the obturating medium passes through a U.S. mesh size 12 filter, and is retained on a U.S. mesh size 50 filter, or U.S. mesh size 40 filter, or U.S. mesh size 36 filter, or U.S. mesh size 30 filter, or U.S. mesh size 24 filter, or U.S. mesh size 20 filter. In some embodiments, at least 85%, or 90%, or 95%, or 97% by weight of the obturating medium passes through a U.S. mesh size 14 filter, and is retained on a U.S. mesh size 50 filter, or U.S. mesh size 40 filter, or U.S. mesh size 36 filter, or U.S. mesh size 30 filter, or U.S. mesh size 24 filter, or U.S. mesh size 20 filter, or U.S. mesh size 16 filter.

While some particles of the obturating medium can be spherical, it is important to have irregularly shaped particles that provide for a higher angle of repose. As used herein, the term "irregular shape" refers to non-spherical shaped particles, such as particles produced by crushing or milling action. For example, in some embodiments, the average degree of circularity of the particles of the obturating medium, and the particles comprising a biodegradable polymer formulation, is less than 0.9. The degree of circularity C can be computed from an image using the equation $C=4\pi A/P^2$, where A is the area and P is the perimeter.

Any methods known in the art can be used to produce the obturating medium, or granular components thereof. For example, a biodegradable polymer formulation can be produced using an extruder, and the resulting nurdles can be subjected to grinding to produce particles comprising biodegradable polymer formulations suitable for use in the obturating medium, e.g., having the appropriate size, density, and shape. Alternatively, for example, a biodegradable polymer can be produced as a powder, and even used unpurified, alone or in conjunction with other components.

Natural materials can be ground or shredded. For example, nut shells such as pecan or walnut can be ground, as can pitted fruits such as apricots. Corn cob hulls can be ground to produce particles suitable for use as obturating medium.

Other compounds can be used as they naturally occur, and simply sorted by size.

The obturating medium need not contain only one type of particles. Mixtures of different particles can be used. Additives such as flow control agents, anti-static agents, pigments or other colorants, degradation enhancers, natural polymers, polysaccharides, stabilizers, plasticizers, desiccants, antimicrobial agents, scent agents, or other additives can included.

The average specific gravity of the particles in the obturating medium should exceed 1.1. As used herein, the term "average specific gravity" refers to a weighted average of the specific gravity of the particles in the obturating medium. An average specific gravity greater than 1.1 is not a necessary characteristic of obturating media in order to have a good gas seal, but it is important in order to have a commercially appealing product. An obturating medium with less dense particles is generally more difficult to load (worse particle flow) and more likely to blow back into a shooter's face after firing. There is one clear advantage in using less dense particles (e.g., less weight of the ejecta). However, the advantages of using obturating medium with specific gravity exceeding 1.1 more than overcomes the disadvantage associated with the extra weight that needs to be accelerated when the cartridge is fired. For example, when such denser particles in the obturating medium enter aquatic environments, they will tend to sink. Moreover, particles greater than 212 microns in size and having a specific gravity greater than 1.1, when fired from the barrel at the high speeds of typical shotgun loads, are unlikely to blow back into a shooter's face after a shot is fired. Generally speaking, particles that are larger and denser tend to deviate less quickly from the initial flight path than smaller, less dense particles that are otherwise equivalent. The specific gravity of the particles comprising a biodegradable polymer formulation in the obturating medium can be greater than 1.1, greater than 1.2, greater than 1.3, greater than 1.4, greater than 1.5, greater than 1.6, greater than 1.7, greater than 1.8, greater than 1.9, greater than 2.0, or greater than 2.5.

Suitable particles that can serve as the basis for the obturating medium can comprise any particle formulations that meet the above-listed characteristics regarding particle size and specific gravity.

In some embodiments, the obturating medium comprises particles comprising polymers.

In some embodiments, the particles of the obturating medium comprise a biodegradable thermoplastic polymer. For example, formulations of biodegradable polyesters comprising a polyhydroxyalkanoate polymer (PHA), polybutylene succinate (PBS), poly(butylene succinate-co-adipate) (PBSA), a polybutylene succinate copolymer other than PBSA (PBS(c)), polycaprolactone (PCL), polylactic acid (PLA), and combinations thereof, can perform this function. However, not all formulations of these polymers will work, either because of the amount, size, or shape of the particles in the obturating medium. A polyester is a polymer in which monomer units are linked together by ester groups. In other embodiments in which biodegradable plastics are used in the obturating medium, other non-polyester polymers are used, for example, biodegradable thermoplastic starch In some embodiments, the obturating medium comprises particles comprising polymers. In some embodiments, the particles of the obturating medium themselves comprise multiple polymers. In particular, they can comprise multiple polymers of plant origin, typically naturally occurring material. For example, the particles of the obturating medium can comprise a mixture of: lignin, one or more hemicelluloses, and cellulose. In other embodiments, the biodegradable polymer comprises a protein, including for example zein, collagen, silk, and/or keratin. In other embodiments, the biodegradable polymer comprises a polysaccharide such as a cellulosic polymer, an alginate, and/or a starch. Cellulosics include plant materials such as ground coffee beans, jute, hemp, and/or cotton, which often include other polymers.

In some embodiments, the obturating medium comprises particles from plant matter including but not limited to nut shells (for example, pecan shells, walnut shells), fruit pits (e.g., cherry pits, apricot pits), corn cob hulls, and rice hulls. In some embodiments, the obturating medium comprises combinations of particles from different plant matter.

Other plant materials can be utilized. For example, we have successfully utilized finely ground espresso beans as an obturating medium. A 3 inch, 12 gauge shotshell was loaded with a smokeless shotshell powder, finely ground espresso beans averaging about 200 microns, and a 1 oz. lead slug, then roll crimped and fired, providing adequate speed and pressure. In general, this obturating medium is not ideal relative to other particulate obturating media, particularly because it does not flow well, although the smell upon firing can be pleasant.

Walnut shell particles can be particularly suitable as a component of obturating medium. Various species of walnut shells can be useful, including black walnut (*Juglans nigra*) and European walnut, although they have different characteristics. Black walnut has a tremendously high modulus of elasticity. It does not easily fracture or create dust at ordinary pressures, which is important as large-scale automated shotshell loading could require huge amounts of obturating media. Dust can be toxic, and consistency from load to load is improved if the particles resist fracturing during transport and storage in, for example, a 2,000 pound supersack. Walnut also is somewhat resistant to microbial decay, meaning that microbial attack and decay is less likely than for some other organic obturating media. This is particularly important as shotshells are not always stored in pristine environments, and are rarely sealed against the elements. Introduction of mold, for example, into a shotshell loaded with obturating medium could quickly change the characteristics of the obturating medium and impair the performance of the shotshell. Walnut shell is harder than many organic materials, with a Mohs hardness of approximately 4, but will not scratch shotgun barrels. Walnut shell media is also a waste product that is inexpensive and readily available. Walnut shell particles also do not tend to absorb as much water from the air as similarly sized particles from other plant species. Walnut shell particles also have excellent flowability parameters, and thus are easy to meter and load, even in smaller particle sizes.

Corn cob hull media also has many positive attributes for use in obturating media. Relative to walnut shell particles, particles of corn cob hulls tend to absorb more water and are more prone to rotting, both of which can be disadvantages. Anti-microbial agents or preservatives (e.g., citric acid, borax) can be incorporated into the particles or obturating media or cartridge to reduce the sensitivity of corn cob hull obturating media (or any other particulate obturating media) to microbial attack. Corn cob media also has advantages. It has a lower bulk density and is more compressible than walnut shell media. The reduced bulk density lowers the weight of the ejecta, and the enhanced compressibility provides for more forgiveness and tolerance during loading and storage of loaded cartridges.

Particles comprising primarily inorganic chemicals can be used as obturating media. In some embodiments, particles containing substantial fractions of both organic and inorganic compounds are used. Many inorganic compounds can be successfully employed as obturating media in accordance with the methods and devices described herein. Many inorganic compounds can be overly hard (harder than 6.5 on a Mohs scale), causing concerns about barrel scratching and making it more difficult to obtain a good gas seal unless very small particles are used. For example, aluminum oxide has a Mohs hardness of approximately 9. Glass beads or crushed glass, as well as sand, can be used. However, these materials generally are disfavored, at least if used on their own, relative to other obturating media described herein. Calcium carbonate particles can be an effective inorganic obturating medium. Other minerals, including gypsum and talc, can also be used.

Naturally occurring shell matter is a particularly useful embodiment in which the obturating medium primarily comprises inorganic matter. For example, granulated eggshells from chickens are primarily calcium carbonate, along with protein. The protein component can be removed. Waste eggshells, when mechanically ground into particles, make excellent obturating media. The eggshells can be from any animal species, with chicken eggshells a good choice because they are readily obtained. They are soft, flow well for easy loading, and have a relatively low bulk density in comparison to a high specific gravity.

This can be an important feature. As described previously, a specific gravity (density relative to water) of greater than 1.1 is important for overall performance of particles in the obturating medium. That said, it is advantageous to minimize additional weight added to the cartridge that is not in the form of projectiles. Accordingly, it can be advantageous to utilize particles having a high ratio of bulk density to specific gravity. For example, the bulk density of granular eggshells is around 1 g/cm$^3$, whereas the specific gravity of eggshell particles is generally greater than 2. It can be advantageous to have a ratio of the bulk density of the obturating media to the average specific gravity of its component particles of less than 0.8 g/cm$^3$. In the case of eggshell particles from chickens, this ratio of bulk density to specific gravity tends to be less than 0.5 g/cm$^3$.

Another advantage of eggshells, shared by some other obturating media, is a tendency for particles in the obturating medium to fragment under the high pressures experienced when a shotshell is fired. As described previously, all else being equal, smaller obturating media provides better gas sealing. Accordingly, when obturating media fragments upon firing, larger particles can be used, which enhances loading (better flowability) and reduces the likelihood of migration of the obturating media into the propellant or projectile components during transportation and storage of a loaded shotshell, while still obtaining some of the enhanced gas sealing provided by smaller particles. A second benefit of this fragmenting characteristic is the in situ buffering that can result. The particulate eggshells tend to fracture into very small pieces when the shotshell is fired, causing immediate mixing of the obturating medium and shot projectiles as the eggshell particles rapidly migrate into interstitial spaces between the shot projectiles, particularly in the proximal portion of the shot layer, which benefits the most from buffering.

Generally speaking, this fragmenting characteristic, if extreme, can create very high pressures and fine dust coming out of the barrel. The high pressure can be controlled for and obviously one aspires to produce consistency between loads. This in situ fragmenting is not limited to eggshells. Many other obturating media undergo some fragmentation when exposed to the high pressures and collisions with hard objects to which obturating medium particles are subjected when a shotshell is fired.

In some embodiments of the invention, the average size of the particles in the obturating medium utilized in a shotshell cartridge is reduced by at least ten percent, or at least 20 percent, or at least 30 percent, or at least 40%, or at least 50%, by the time said particles exit a gun that has fired the cartridge.

One downside of eggshells when used as obturating media according to the methods described herein is a slightly unpleasant odor when the cartridge is fired. Additives can be added to mask that smell, or the eggshells can be subjected to an oxidative process (e.g., bleaching) to eliminate the sulfurous smell.

Shells from aquatic creatures also have many of the same attributes as eggshells, although their exact chemical composition tends to differ. For example, crustacean shells such as crab shells or shrimp shells are high in chitin. Shellfish (mollusks) shell particles also are very effective when used as obturating media in accordance with the methods described herein. For example, oyster shells of appropriate size are useful as obturating media.

A significant advantage of some obturating media compared with others is a reduced tendency to absorb water from the air, thereby providing greater performance consistency over time. Particles that absorb substantial quantities of water can increase mass and volume within the hull, which can impact pressure upon firing. In some embodiments, the water absorption of the obturating medium is less than 1% at 23° C., as measured by ASTM D570—Standard Test Method for Water Absorption of Plastics. In some embodiments, the water absorption of the obturating medium is less than 2%, or 3%, or 4%, or 5%, at 23° C., as measured by ASTM D570—Standard Test Method for Water Absorption of Plastics.

In some embodiments, shotshell cartridges are loaded with a propellant, obturating media, and shot projectiles, wherein the shot is typically made from lead, steel, bismuth, tungsten, coated varieties thereof, or any other shot material known in the art. Generally speaking, buffered shot loads outperform conventional non-buffered loads, particularly when softer shot materials such as lead or bismuth are used. In such buffered loads, small particles are mixed into the layer of shot.

Particulate obturating medium can serve as buffer for shotshells. Such loads can have outstanding performance characteristics. High-speed loading of buffered shotshells is known to be problematic in the art because (i) the introduction of buffer particles can be messy; (ii) mixing the buffer particles with the shot can also be messy; (iii) mixing of the buffer with the shot projectiles changes the volume of solid material in the shotshell; that is, small buffer particles migrate into interstitial spaces between the shot projectiles, reducing the volume occupied by the unmixed fractions of buffer and shot. Menefee describes an improved process for mixing buffer and shot projectiles in United States Patent Application Publication No. 20190226822, the contents of which are hereby incorporated by reference. Briefly, the buffer and shot are introduced into a shotshell, and a coaxially aligned tube is plunged into the mix and withdrawn one or more times, resulting in effective and immediate mixing, particularly when used with shot sizes smaller than #6 shot. This method is referred to herein as the "plunge method".

When used according to the methods of the invention, obturating media can be particularly effective not only for gas sealing but also buffering. For example, 20/30 walnut shell media can be added to a cartridge after the propellant powder, followed by shot projectiles. The plunge method can be used to mix the walnut shell media and the shot, creating a buffered load. In another embodiment, a portion of the obturating medium is added to the propellant, followed by shot, followed by obturating medium. The shotshell is then subjected to a mixing process, either with the plunge method or any other method known in the art, in order to thoroughly mix the obturating medium into the layer of shot.

Typically, in these buffered embodiments, care is taken to ensure that there is still a layer of obturating medium at least 2 mm thick between the projectile powder and the most proximal shot projectile.

Figure 4:
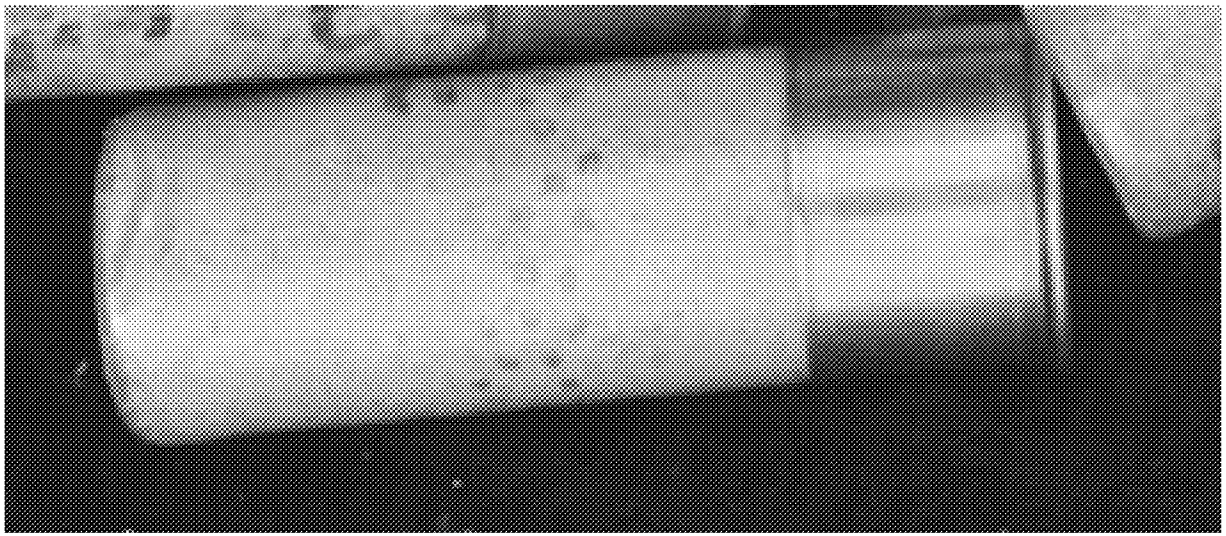
FIG. 4 is a photographic image of one embodiment of a shotgun shell loaded with particulate obturating medium that is also a buffering agent as described herein.

FIG. 4 shows an image of such a load, wherein a 12 gauge hull has been successively loaded with smokeless powder, particulate obturating medium comprising walnut media wherein at least 85% by weight of the particles pass through a 20 mesh filter and are retained on a 40 mesh filter, and lead shot. The plunge method was used to mix the shot and the walnut shell particles, yielding a continuous layer of walnut shell particles serving as both buffer and obturating medium. The shot is generally obscured by the obturating media, but some of the shot projectiles are not fully obscured and can be seen in the image.

While the methods used herein can be used to produce very high-performing, pre-mixed buffer loads, the mixing step does increase the costs of loading. In many cases, manufacturers would prefer to avoid the mixing step. The "three-piece" load is valued in the shotshell industry. This entails sequentially adding to a primed cartridge the propellant, a gas seal (typically a wad that also includes a cup portion), and the projectile(s). To our knowledge, no one has previously described a three-piece load using particulate obturating media in place of a wad wherein the load can be subjected to substantial shaking and vibration (e.g., when being transported on a truck across the country and while being carried by a hunter walking through the woods) and still be shot with high performance at a velocity greater than 1,000 feet per second.

Instead, particulate obturating media known in the art (see U.S. Pat. Nos. 8,276,519 and 7,814,820) do not perform well as a three-piece load because the small particles in the obturating medium tend to migrate into the projectile shot layer during conditions of normal transport, storage, and use. This migration process reduces the apparent volume occupied by the ejecta in the shotshell. The migration of the obturating medium into the shot layer reduces the linear volume of the obturating medium more than it increases the linear volume of the shot layer, since the particles from the obturating medium mostly settle into void spaces between the shot. The resulting air pocket void can also eventually lead to migration of the powder as well if the cartridge is shaken while oriented horizontally. Irrespective of whether the propellant powder also migrates, the void space itself can negatively impact the ballistics of the shotshell, as the back pressure from the crimp is reduced. When the cartridge is fired, there is less resistance against initial motion, often resulting in a shot fired with poor pressure and velocity.

In contrast, we have identified particulate obturating media that can be loaded as three-piece loads and do not significantly migrate into the shot layer. Compromised performance is avoided, irrespective of the substantial shaking and vibration to which shotshells are often subjected during routing transport, storage, and use. Instead, shotshells as described herein perform up to high standards, shooting at consistent pressures above 5,000 psi and velocities exceeding 1,000 fps, even after being subjected to accelerated migration testing or normal transport, storage, and use. One version of accelerated migration testing is to insert a loaded shotshell into a small covered container such as a pill bottle, and carry the pill bottle in a pants pocket while walking a distance of several miles over rough terrain. The shotshell is thus subjected to agitation in all directions, including tapping at both ends of the cartridge which facilitates migration of particles.

Figure 5:
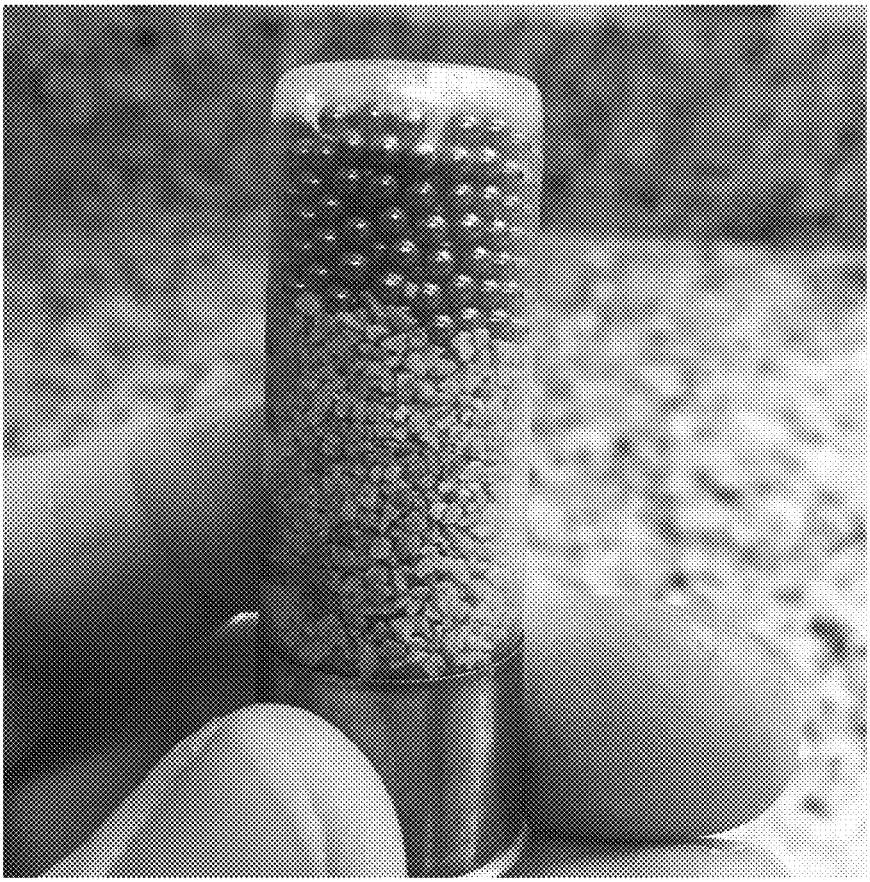
FIG. 5 is a photographic image of one embodiment of a shotgun shell loaded with particulate obturating medium as described herein.

FIG. 5 shows a photographic image of such a loaded shotshell, wherein a 12 gauge hull has been successively loaded with smokeless powder, roughly 70 grains of walnut media wherein at least 90% by weight of the particles pass through a 14 mesh filter and are retained on a 20 mesh filter, and 1 ounce of #8 lead shot. This shotshell was transported many miles on a truck and subjected to accelerated migration testing, and clearly shows minimal if any migration between the layers.

Figure 6:
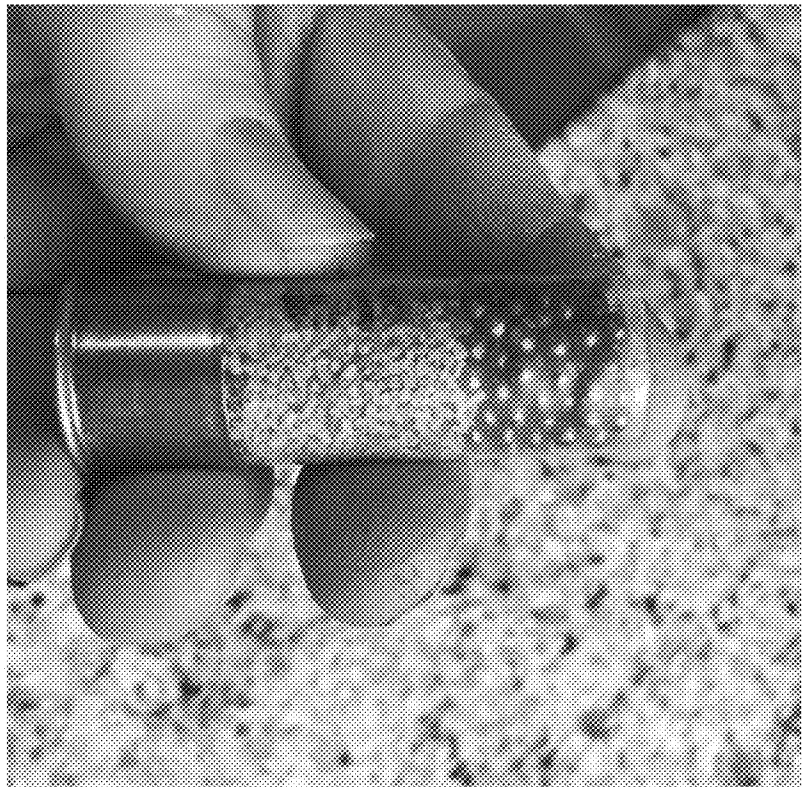
FIG. 6 is a photographic image of one embodiment of a shotgun shell loaded with particulate obturating medium and bismuth shot as described herein.

FIG. 6 shows a photographic image of another shotshell loaded successively with smokeless powder, roughly 70 grains of walnut media wherein at least 90% by weight of the particles pass through a 14 mesh filter and are retained on a 20 mesh filter, and #4 bismuth shot. This shotshell was subjected to accelerated migration testing, and shows minimal if any migration between the layers.

The exact parameters of the particulate obturating medium that can be used in a three-piece load depend somewhat on the composition of the obturating medium (e.g., obturating medium with worse flow characteristics can be smaller), the size of the shot (e.g., larger shot requires larger particles in the obturating medium to avoid migration), and the linear volume occupied by the obturating medium in a cartridge, among other things. Generally speaking, obturating media having at least 90% of particles greater than 840 microns in size can be used to eliminate migration concerns when used in conjunction with shot projectiles larger than #4 shot. In some embodiments, larger particles in the obturating medium are preferable, providing gas sealing is not compromised. For example, obturating media wherein the average particle size is greater than 900 microns, or 1,000 microns, or 1,100 microns, or 1,200 microns, or 1,300 microns, or 1,400 microns can be particularly effective in three-piece loads. In other embodiments, at least 90% by weight of the obturating media is retained on a filter having a mesh size of 840 microns, or 900 microns, or 1,000 microns, or 1,100 microns, or 1,200 microns, or 1,300 microns, or 1,400 microns. As the size of the shot decreases, or the flowability of the obturating medium decreases, then one can utilize obturating medium having increasingly small particle sizes in a three-piece load while avoiding problems due to migration. Note that particle size is not the only factor which influences migration. Other physical characteristics (including shape, hardness, and flowability) also are important.

For example, in a .410 gauge shotshell wherein the obturating medium occupies 15 mm of linear volume, a three-piece load can perform exceptionally well using 14/20 corn cob obturating media. In contrast, when 20/30 walnut shell media (most particles are between 595 and 841 microns) is used as obturating medium in a shotshell with number 8.5 lead shot, substantial migration occurs from the obturating medium into the shot layer, which will create a void space in the shell and cause poor performance. Increasing the average particle size of the walnut obturating medium above 841 microns can eliminate this problem. However, for some loads using walnut shell media as obturating medium, formulations with larger particles (e.g., 12/16 walnut media) can have poor gas sealing characteristics.

Accordingly, when particles of the obturating medium are too small, one gets good gas sealing but also unwanted migration into the shot layer, compromising performance. When particles of the obturating medium are too large, one eliminates migration into the shot layer, but gas sealing is poor, again compromising performance. Note that a small amount of migration of smaller particles is acceptable and will not unduly compromise the load and is contemplated herein.

It is important that the particles used in the obturating medium do not remain as persistent organic pollutants after being fired. When thermoplastic polymers are used in the obturating medium, it is important that these polymeric particles biodegrade. Suitable biodegradable polymer formulations can comply with one or more definitions of biodegradable. The ASTM D6400 is entitled Standard Specification for Labeling of Plastics Designed to be Aerobically Composted in Municipal or Industrial Facilities. See ASTM Standard D6400, 2004, "Standard Specification for Compostable Plastics," ASTM International, West Conshohocken, Pa., 2004, DOI: 10.1520/D6400-04, www.astm.org, wherein the ASTM Standard D6400, 2004 is incorporated by reference in its entirety. The ASTM D6400 identifies three governing provisions that must be met: the product must physically degrade such that the product is not "readily distinguishable" from the surrounding compost, the product must be consumed by microorganisms at a rate comparable to other known compostable materials, and the product cannot adversely impact the ability of the compost to support plants. This specification covers plastics and products made from plastics that are designed to be composted in municipal and industrial aerobic composting facilities.

As used herein, a "biodegradable" formulation means a formulation that satisfies ASTM D6400 (any version thereof, including ASTM D6400-04), ASTM D6868, or EN 13432.

In some embodiments, a material is biodegradable if it undergoes degradation by biological processes during composting to yield $CO_2$, water, inorganic compounds, and biomass at a rate consistent with other known compostable materials. Degradation can be defined by a deleterious change in the chemical structure, physical properties, or appearance of the material. See ASTM D6400, 2004. A biodegradable material can be defined by the ability to completely break down and return to nature, i.e., decompose into elements found in nature within a reasonably short period of time such as one year after customary disposal. A biodegradable material can be defined as a material wherein all the organic carbon can be converted into biomass, water, carbon dioxide, and/or methane via the action of naturally occurring microorganisms such as bacteria and fungi, in timeframes consistent with the ambient conditions of the disposal method. See ASTM D883.

The obturating medium described herein, when comprising primarily organic polymers, comprises particles comprising a biodegradable polymer formulation, wherein the content of the biodegradable polymer in said biodegradable polymer formulations comprises by weight at least 10% of the total weight of the biodegradable polymer formulation, or at least 20%, at least 30%, at least 40%, at least 50%, at least 60%, at least 70%, at least 80%, at least 90%, or at least 95%, or ranges incorporating any of the foregoing values. More than one biodegradable polymer can be used in such biodegradable polymer formulations.

Polyhydroxyalkanoates (PHA) are biological polyesters synthesized by a broad range of natural and genetically engineered bacteria as well as genetically engineered plant crops. In general, a PHA is formed by polymerization of one or more monomer units inside a living cell.

Over 100 different types of monomers have been incorporated into PHA polymers (Steinbuchel and Valentin, 1995, FEMS Microbiol. Lett. 128:219-228). Examples of monomer units incorporated in PHAs include 2-hydroxybutyrate, lactic acid, glycolic acid, 3-hydroxybutyrate (hereinafter referred to as 3HB), 3-hydroxypropionate (hereinafter referred to as 3HP), 3-hydroxyvalerate (hereinafter referred to as 3HV), 3-hydroxyhexanoate (hereinafter referred to as 3HH), 3-hydroxyheptanoate (hereinafter referred to as 3HHep), 3-hydroxyoctanoate (hereinafter referred to as 3HO), 3-hydroxynonanoate (hereinafter referred to as 3HN), 3-hydroxydecanoate (hereinafter referred to as 3HD), 3-hydroxydodecanoate (hereinafter referred to as 3HDd), 4-hydroxybutyrate (hereinafter referred to as 4HB), 4-hydroxyvalerate (hereinafter referred to as 4HV), 5-hydroxyvalerate (hereinafter referred to as 5HV), and 6-hydroxyhexanoate (hereinafter referred to as 6HH). 3-hydroxyacid monomers incorporated into PHAs are the (D) or (R) 3-hydroxyacid isomer with the exception of 3HP which does not have a chiral center.

In some embodiments, the PHA in the methods described herein is a homopolymer (where all monomer units are the same). Examples of PHA homopolymers include poly 3-hydroxyalkanoates (e.g., poly 3-hydroxypropionate (hereinafter referred to as P3HP), poly 3-hydroxybutyrate (hereinafter referred to as PHB) and poly 3-hydroxyvalerate), poly 4-hydroxyalkanoates (e.g., poly 4-hydroxybutyrate (hereinafter referred to as P4HB), or poly 4-hydroxyvalerate (hereinafter referred to as P4HV)) and poly 5-hydroxyalkanoates (e.g., poly 5-hydroxyvalerate (hereinafter referred to as P5HV)).

In certain embodiments, the starting PHA can be a copolymer (containing two or more different monomer units) in which the different monomers are randomly distributed in the polymer chain. Examples of PHA copolymers include poly 3-hydroxybutyrate-co-3-hydroxypropionate (hereinafter referred to as PHB3HP), poly 3-hydroxybutyrate-co-4-hydroxybutyrate (hereinafter referred to as PHB4HB), poly 3-hydroxybutyrate-co-4-hydroxyvalerate (hereinafter referred to as PHB4HV), poly 3-hydroxybutyrate-co-3-hydroxyvalerate (hereinafter referred to as PHB3HV), poly 3-hydroxybutyrate-co-3-hydroxyhexanoate (hereinafter referred to as PHB3HH) and poly 3-hydroxybutyrate-co-5-hydroxyvalerate (hereinafter referred to as PHB5HV). By selecting the monomer types and controlling the ratios of the monomer units in a given PHA copolymer, a range of material properties can be achieved.

In some embodiments, mixtures of different PHA polymers can be used. In some embodiments, amorphous PHA is combined with another PHA polymer. In some embodiments, PHA can be used as either a flow control additive or as the primary component of the obturating medium, or both, depending on the size, shape, and composition of the PHA particles.

PBS(x) refers to the polybutylene succinate family of polymers, which includes polybutylene succinate and polybutylene succinate copolymers that can be synthesized via condensation of succinic acid, 1,4-butanediol, and one or more additional diacids. For example, adipic acid is the diacid co-monomer that is added to produce PBSA, which is also referred to as poly(butylene succinate-co-adipate) or polybutylene succinate adipate. As contemplated herein, the content of the succinic acid co-monomer in PBS(x) can be between 60% and 100%. This concentration would be 100% when the polymer is PBS (i.e., when there is no co-monomer component), and the concentration of the succinic acid co-monomer can be as low as 60% for copolymers such as PBSA. As described herein, PBS(c) refers to polybutylene succinate copolymers containing a diacid co-monomer other than adipic acid.

PHA, PBSA, PBS, PCL, and some PBS(c) polymers eventually break down into benign monomers, oligomers, and byproducts. Many conventional plastics do not degrade into benign monomers and oligomers in terrestrial or aquatic environments. PLA also biodegrades, although typically more slowly than other biodegradable polyesters listed above. Other biodegradable polyesters, including those not yet commercially available, can be used according to the methods and articles of the disclosure.

In some embodiments of the invention, plant materials are used, typically plant materials that occur naturally; for example, granulated nut shells, rice hulls, or corn cobs. These plant materials typically are cellulosic in nature, and often include a combination of the polymers cellulose, lignins, and hemicelluloses.

Lignins (also referred to as the singular lignin) are a class of complex phenolic polymers, and are the second most abundant organic polymers on earth, exceeded only by cellulose. The composition of lignin varies from species to species.

Hemicelluloses are polysaccharides that typically co-present with cellulose, although they are structurally different. Cellulose consists entirely of linked glucose units, whereas hemicelluloses can include a number of other sugars besides glucose, including for example the five-carbon sugars xylose and arabinose and the six-carbon sugars mannose and galactose. Hemicelluloses can also contain acidified sugars such as glucuronic acid and galacturonic acid.

The specific ratio of cellulose to lignin to hemicelluloses varies across species and across components of the same plant. In typical embodiments, when obturating media comprises particles from plant matter, the particles comprise at least 10% by weight of each of cellulose, lignin, and hemicellulose.

The methods, cartridges, and obturating media described herein are useful in many applications.

In one embodiment, they can be used to produce blanks; i.e., shotshells that do not launch conventional projectiles such as lead shot or steel shot. For example, blanks are widely used for gun-dog training, where they are sometimes referred to as poppers. Pre-formed wads can be used in such blank cartridges, but the blanks can also be made by simply combining a primed hull, a propellant (e.g., a smokeless powder, or black powder, or any suitable propellant), and a suitable obturating medium as described herein. An overshot wad of some sort, for example, can be used, but is not necessary. In such embodiments that utilize an overshot wad, a frangible overshot wad made from biodegradable polymers is preferable. The cartridge is crimped, optionally sealed, and can then be fired.

In one embodiment of a blank shotshell cartridge, a primed hull is loaded with smokeless powder, then 14/24 walnut shell obturating media is added to fill the hull, which is then crimped, wherein at least 95% by weight of the 14/24 walnut shell media passes through a 14 mesh filter and is retained on a 24 mesh filter.

In one embodiment, the methods, cartridges, and obturating media described herein are useful for cleaning the barrel of a gun; for example, a shotgun. For example, a hunter might conclude a day of hunting by firing a cartridge useful for cleaning the barrel of a gun to remove residue on the barrel that builds up as shots are fired. To make such a load, a propellant, typically a very clean-burning propellant, such as a single base powder made from nitrocellulose, is added to a primed cartridge, along with obturating medium. Optional additional components include pre-formed wads, abrasive particles, cleaning disks, cleaning pads, or other components. By obturating to form a highly effective, flexible gas seal, the particulate obturating medium also can provide effective cleaning of a barrel.

When a large fraction of the cartridge comprises obturating medium, the obturating medium is typically added in multiple doses, with some mechanical means for removing trapped air (e.g., by shaking, agitation, compression, pressure) in between successive additions of the granular obturating medium. When a smaller fraction of the cartridge comprises obturating medium, then it is typically added in a single dose.

In some embodiments, including three-piece loads, to a primed hull is added successively powder, obturating medium, and shot. The components are typically then compressed, commonly via a rod inserted into the cartridge with insufficient pressure to cause it to bulge, but sufficient pressure to help compress and settle the contents and remove air.

In one embodiment, the methods, cartridges, and obturating media described herein are useful for conventional projectile loads; for example, wherein the cartridge projectile comprises steel, bismuth, tungsten, tin, iron, copper, zinc, aluminum, nickel, chromium, molybdenum, cobalt, manganese, antimony, alloys thereof, composites thereof, or any combinations thereof. The projectile can be any type of shot including birdshot and buckshot, a slug, or other projectiles.

For example, in one embodiment, to a primed hull is successively added propellant, obturating medium, a spacer wad and lead shot. The hull is then crimped, optionally sealed, and eventually fired from a gun.

In another embodiment, to a primed hull is successively added propellant, obturating medium, and then a mixture of lead shot and buffer, followed by an overshot wad. The hull is then star-crimped and fired. In a similar embodiment, additional obturating medium can also serve as a buffer.

In another embodiment, to a primed hull is successively added propellant, a spacer wad, obturating medium, a cup wad (typically made from a biodegradable material such as a cellulosic fiber), and steel shot.

In another embodiment, to a primed hull is successively added propellant, 80 grains obturating medium, and a lead slug. The hull is roll-crimped and fired. Any suitable shot material can be used, and any suitable wads can be optionally added. For steel shot or other hard, non-lead shot materials such as tungsten or tungsten alloys, the gun barrel should be protected beyond the capacity of the obturating medium to do so, and hence in such embodiments, a pre-formed wad of some sort is recommended.

In some embodiments, the particulate obturating medium is wholly or partially contained within a flexible material such as a textile (including knitted, woven, and nonwoven textiles), paper, cardboard, fiberboard, or a soft biodegradable plastic. Typically, the flexible container additionally contains the projectile, and can be particularly useful in preventing hard shot material (such as tungsten or steel shot) from contacting and potentially scratching the barrel of a gun. Importantly, there is no need for an additional pre-formed gas sealing wad, since the particulate obturating medium provides that benefit.

In one such embodiment, a shotshell is successively loaded with smokeless powder, a flexible container in the form of a paper cup-style wad, particulate obturating medium as described herein, and steel shot. When this shotshell is fired, the particulate obturating medium expands outward, pressing the paper cup outward to form a gas seal. Importantly, the flexible container must be flexible enough to deform significantly when the particulate obturating medium presses outwards against the contours of the flexible container. Most conventional plastic shot wads or cup-style plastic wads are too stiff to perform this function since they are unable to deform sufficiently (unlike typical plastic gas seal wads, which are designed to obturate under pressure).

In some embodiments utilizing a flexible container, the flexible container has a bottom portion separating the particulate obturating medium from the propellant. For example, the flexible container can be a pressed fiber or paper cup. In other embodiments, the flexible container is a generally tubular structure open at both ends. Typically, the flexible container, while flexible, is sufficiently thick and/or tough to provide protection to a shotgun barrel from shot projectiles that might otherwise scratch the barrel.

In some embodiments that utilize a flexible container, the cartridge is used not for the purpose of shooting projectiles, but rather to clean a gun; for example, to clean the bore of a shotgun. For example, in one such embodiment of a cleaning load, a primed hull is successively loaded with propellant (preferably a clean-burning powder including single-base powders), a flexible container comprising a textile, an optional pre-formed wad, and obturating medium. In some such embodiments, the flexible container does not extend all the way up the sides of the hull. In some embodiments, the flexible container is a stiff cellulosic fabric having a basis weight of at least 10 ounces per square yard. In some embodiments, the obturating medium comprises glass beads, which can impart a polishing effect. In some embodiments, the flexible container is wrapped around a fiber wad and co-inserted into the shell during the loading process. It has been found that the outward pressure imparted by the obturating medium on a flexible textile container when a cleaning cartridge is fired at a speed exceeding 400 feet per second does an excellent job of removing lead and other contaminants from a shotgun bore.

In some embodiments, the obturating medium is used in factory loading conditions to produce cartridges as described herein.

In other embodiments, the obturating medium is used for hand-loading to produce cartridges as described herein. In some such embodiments, an obturating medium as described herein is used by reloaders to produce cartridges. This is particularly advantageous for reloaders seeking environmentally responsible loads that lack conventional plastic, especially if the desired shells are for gun sizes for which a wide selection of suitable commercially available wads is not available. A manufacturer also benefits, as rather than requiring injection molds of all different sizes for different barrel sizes, the obturating medium can be used with any size barrel.

In an embodiment, the methods, cartridges, and obturating media described herein are useful for so-called "less lethal" loads. Less lethal loads often use projectiles or payloads made from materials such as rubber, salt, or plastic. One problem with these conventional less lethal loads is that they typically use a pre-formed wad, which is fired with great velocity. While the projectiles may be less lethal than typical shot materials such as lead or steel, the wad itself can be deadly. For example, such wads in less lethal loads are often capable of embedding or going through plywood within a distance of about five yards. Less lethal loads made according to the methods described herein are inherently safer since a pre-formed wad is not used. For example, in one embodiment, a primed hull is loaded sequentially with propellant (e.g., a smokeless powder), obturating medium, and projectiles selected from the group consisting of rubber, salt, cellulosic, and plastic projectiles. After crimping, the cartridge can be shot into a crowd with enhanced safety relative to conventional less lethal loads.

In some embodiments, the projectile is a frangible projectile, a rubber projectile, a bean bag projectile, a tear gas-containing projectile, an oleoresin *Capsicum*-containing projectile, a liquid-filled marking projectile, a tracer projectile, a penetrator projectile, a flechette projectile, an armor-piercing projectile, an incendiary projectile, a flare projectile, a chemical particulate-containing projectile, or any combination thereof.

In another embodiment, a cartridge is loaded with propellant, obturating medium, and fire suppressant material. In one such embodiment of a fire suppressant cartridge, the particulate obturating medium comprises calcium carbonate, including but not limited to shell matter such as ground eggshells or oyster shells.

The obturating media described herein are compatible with various types of shotgun shells and other types of cartridges. The obturating medium provides one or more of the primary functions of a shotgun wad. It provides an excellent gas seal, and can separate the projectile from the propellant, and can also be used to enhance shot patterns by serving as a buffer. It is anticipated that the obturating medium will be incorporated, for example, into shotgun shells used for any kind of hunting or target shooting.

In some embodiments, two or more types of particulate obturating media are mixed prior to loading. In other embodiments, two or more types of particulate obturating media are successively loaded. For example, in one representative embodiment, a primed 12 gauge hull is successively loaded with 26 grains of a smokeless powder, 50 grains of 20/30 walnut shell media, 15 grains of 14/20 corn cob media, one ounce of #8 lead shot, and then crimped.

The obturating medium can be combined, for example, with other shotgun shell loading components in any suitable manner, such other components including other wads as desired (e.g., overshot wad, shot wad, cushioning wad, filler wad, etc.), any size or suitably shaped hull, primer, powder, shot, buffer, etc. For example, hulls can be for 8 ga, 10 ga, 12 ga, 16 ga, 20 ga, 24 ga, 28 ga, 32 ga, or .410 bore shotguns, and can be any appropriate length (e.g., including but not limited to 2½ inch, 2¾ inch, 3 inch, 3½ inch) and shape (e.g., straight sides, tapered). Any suitable shot material can be used, including but not limited to lead, steel (including cast steel), tungsten, bismuth, and alloys and coated shot and combinations thereof, in any suitable size (including but not limited to the range from No. 10 shot all the way to 000 buckshot), in any shape (including but not limited to spherical, rough spherical, and hexagonal), and in any payload. The obturating medium can be used with slug projectiles. In some shotshell embodiments, a particulate obturating medium forms a gas seal, and a supplemental biodegradable wad contains the shot. For example, a primed hull can be successively loaded with propellant powder, a particulate obturating medium, a biodegradable wad, shot, and then crimped. In one such embodiment, a primed hull is successively loaded with smokeless powder, 20/40 walnut shell media, a cellulosic fiber cup wad, and steel shot, then crimped. In another such embodiment, a primed hull is successively loaded with smokeless powder, 20/40 corn cob media, a cellulosic fiber cup wad, and tungsten super shot, then crimped. In another such embodiment, a primed hull is successively loaded with smokeless powder, 20/30 walnut shell media, a frangible cup wad comprising a PHA polymer, and a tungsten alloy shot, then crimped.

Some manufacturers claim that their shotgun wads are degradable. However, these wads often consist of non-degradable plastic in a matrix of degradable materials. The degradable materials break down leaving behind small fragments of non-degradable plastic. Non-degradable plastics can break apart over time into smaller and smaller pieces. These microplastics pose substantial risk to the entire aquatic food web. Microplastic fragments range in size from a few to five hundred micrometers. Due to their abundance, microplastics have become a significant marine debris concern worldwide. Once microplastics enter the aquatic ecosystem, their buoyancy, size, and longevity within the water column lead to ongoing problems. Microplastics can be ingested by both pelagic and benthic organisms. Studies have shown microplastic uptake by marine species including filter-feeders, detritivores, deposit feeders, and planktivores. Microplastics accumulate in the fatty tissue of aquatic species. The fatty tissues become more concentrated with microplastics as organisms mature, posing a significant risk for higher order species. For instance, studies have shown the tropic transfer of microplastics from mussels to the crabs that feed on them (Farrell, P. and K. Nelson. 2013. Trophic level transfer of microplastic: *Mytilus edulis* (L.) to *Carcinus maenas* (L.). Environmental Pollution 177: 1-3).

An increasing concern is that microplastics can sorb and concentrate contaminants and pollutants. Therefore, not only are microplastics accumulating in the tissues of organisms, but pollutants are also accumulating. These pollutants are transported throughout the food web to organisms at various trophic levels. Therefore, non-degradable shotgun wads ultimately contribute to the destruction of the aquatic ecosystem.

Additionally, many non-biodegradable polymers (such as polyethylene) float in water, causing a plastic wad in an aquatic environment to sometimes remain suspended in the water column and travel long distances.

The time to degradation of biodegradable polymers is complicated by the variability in different micro-environments around the planet. For example, underwater aquatic environments can have substantial variability in terms of pressure, temperature, salinity, and biodiversity, all of which can impact the rate of degradation. The high surface area of the particles of the obturating medium accelerates the biodegradation process when such particles comprise biodegradable polymers such as, for example, lignin, cellulose, hemicellulose, starch, and biodegradable polyesters.

EXAMPLES

Polymer resins can be obtained from numerous suppliers. For example, PHA can be obtained from Danimer Scientific in Bainbridge, Ga.; PLA can be obtained from NatureWorks in Minnetonka, Minn.; and PCL can be obtained from Perstorp in Warrington, England. Polymer resins can also be obtained from other suppliers. Polymers of other types can be obtained from many sources, including as waste products. There are many commercial sources of walnut shell media, corn cob media, granulated oyster shells, calcium carbonate, and other obturating media described herein.

Example 1

A granular formulation of PHA (MIREL® M2100, made by Metabolix Inc. in Cambridge, Mass.) comprising primarily particles between 150 microns and 212 microns in size was used as an obturating mix. A 3", 12 gauge shotshell was loaded with a smokeless shotshell powder, the PHA obturating mix, and a 1 oz. lead slug, then roll crimped and fired, yielding a pellet velocity of 1331 fps. This material sealed well as an obturating medium, but was not suitable for high-speed, automated factory loading because of poor flow characteristics.

Example 2

A granular formulation of polybutylene succinate comprising primarily particles between 212 microns and 420 microns in size was used as an obturating medium. A 3", 12 gauge shotshell was loaded with a smokeless shotshell powder, the PBS obturating medium, and a 1 oz. lead slug, then roll crimped and fired, yielding a pellet velocity of 1347 fps.

Example 3

A granular formulation of polycaprolactone comprising primarily particles between 420 microns and 600 microns in size was used as an obturating medium. A 3", 12 gauge shotshell was loaded with a smokeless shotshell powder, the PCL obturating medium, and a 1 oz. lead slug, then roll crimped and fired, yielding a pellet velocity of 1327 fps.

Example 4

A granular formulation of polycaprolactone comprising primarily particles between 212 microns and 420 microns in size was used as an obturating medium. A 3", 12 gauge shotshell was loaded with a smokeless shotshell powder, the PCL obturating medium, and a 1 oz. lead slug, then roll crimped and fired, providing suitable speed and pressure.

Example 5

A granular formulation of polybutylene succinate comprising primarily particles between 420 microns and 850 microns in size was used as an obturating medium. A 3", 12 gauge shotshell was loaded with a smokeless shotshell powder, the PBS obturating medium, and a 1 oz. lead slug, then roll crimped and fired, providing suitable speed and pressure.

Example 6

A granular formulation of PHA (MIREL® M2100, made by Metabolix Inc. in Cambridge, Mass.) comprising primarily particles between 212 microns and 420 microns in size was used as an obturating medium. A 3", 12 gauge shotshell was loaded with a smokeless shotshell powder, the PHA obturating medium, and a 1 oz. lead slug, then roll crimped and fired, providing suitable speed and pressure, and flowing well enough to load using high-speed factory equipment.

Example 7

A granular formulation of polycaprolactone comprising primarily particles between 150 microns and 212 microns in size was used as an obturating medium. A 3", 12 gauge shotshell was loaded with a smokeless shotshell powder, the PCL obturating medium, and a 1 oz. lead slug, then roll crimped and fired.

Example 8

A granular formulation of polycaprolactone comprising primarily particles between 420 microns and 850 microns in size was used as an obturating medium. A 2¾ inch, 12 gauge shotshell was loaded with 20 grains of a smokeless shotshell powder, filled up with the PCL obturating medium (roughly 130 grains), then star-crimped and fired, yielding average pressure of 10,200 psi.

Example 9

A granular formulation of polycaprolactone comprising primarily particles between 212 microns and 450 microns in size was used as an obturating medium. A 2¾ inch, 12 gauge shotshell was loaded with 20 grains of a smokeless shotshell powder, filled up with the PCL obturating medium (roughly 130 grains), then star-crimped and fired, yielding a pressure of 10,000 psi.

Example 10

A granular formulation of polylactic acid comprising particles exceeding 850 microns in size was used as an obturating medium. 2.75", 12 gauge shotshells were loaded with 20 grains of a smokeless shotshell powder, filled up with the PLA obturating medium (roughly 130 grains), then star-crimped and fired. Adequate pressures averaging 10,850 psi were achieved, indicating proper sealing. When fired, these blanks tore off the top of the hulls.

Example 11

A granular formulation of polylactic acid comprising primarily particles between 420 microns and 850 microns in size was used as an obturating medium. 2¾ inch, 12 gauge shotshells were loaded with 20 grains of a smokeless shotshell powder, filled up with the PLA obturating medium (roughly 130 grains), then star-crimped and fired. Adequate pressures averaging 10,650 psi were achieved, indicating proper sealing, with no torn hulls.

Example 12

A granular formulation of polybutylene succinate comprising primarily particles between 212 microns and 420 microns in size was used as an obturating medium. A 2¾ inch, 12 gauge shotshell was loaded with 20 grains of a smokeless shotshell powder, filled up with the PBS obturating medium (roughly 145 grains), then star-crimped and fired, yielding an average pressure of 11,350 psi.

Example 13

A granular formulation of polybutylene succinate comprising primarily particles between 150 microns and 212 microns in size was used as an obturating medium. A 2¾ inch, 12 gauge shotshell was loaded with 20 grains of a smokeless shotshell powder, filled up with the PBS obturating medium (roughly 140 grains), then star-crimped and fired, yielding average pressures of over 12,500 psi, a higher pressure than is desirable.

Example 14

A granular formulation of polypropylene comprising primarily particles greater than 212 microns in size was used as an obturating medium. A 2¾", 12 gauge shotshell was loaded with 20 grains of a smokeless shotshell powder, filled up with the polypropylene obturating medium, then star-crimped and fired, yielding average pressures below 8,500 psi. These pressures were lower than desired, indicating insufficient sealing with the polypropylene obturating medium.

Example 15

A granular formulation of a commercial polystyrene buffer (Precision Reloading's "PSB" Spherical Shotshell Buffer, available from www.precisionreloading.com) was used as an obturating medium. A 2¾", 12 gauge shotshell was loaded with 20 grains of a smokeless powder, filled up with roughly 120 grains of the polystyrene buffer, then star-crimped and fired, yielding average pressures of around 8,000 psi. These pressures were lower than desired, indicating insufficient sealing with the polystyrene spherical particles.

Example 16

A granular formulation of 12/20 walnut media comprising primarily particles between 841 microns and 1,680 microns in size was used as an obturating medium. A 2.5 inch, .410 gauge Cheddite hull was loaded with a smokeless shotshell powder, 13 grains of a 12/20 walnut media (which occupied 0.55 inches), and ½ ounce number 8.5 lead shot, then star-crimped and fired. Three of these shotshells were fired in succession, yielding a series of pressures with little variation of 8,900, 9,100, and 8,900 psi.

Example 17

A granular formulation of 14/20 corn cob media comprising primarily particles between 841 microns and 1,410 microns in size was used as an obturating medium. A series of 2.5 inch, .410 gauge Cheddite hulls were loaded with a smokeless shotshell powder, 10 grains of 14/20 corn cob media, and ½ ounce number 8.5 lead shot, then star-crimped and fired. When fired, these shotshells developed significantly lower pressures than otherwise equivalent shotshells in which the only difference was substitution of an equal volume of walnut media for the corn cob hulls. These shotshells had good velocities and excellent gas sealing properties, and were quite forgiving during the loading process because of the compressibility of the corn cob hulls.

Example 18

Loads similar to those used in the previous two examples were made using 16/20 walnut media or 16/20 corn cob media comprising particles that passed through a 16 mesh filter and were retained on a 20 mesh filter, corresponding to sizes between 1,190 microns and 840 microns. A series of roughly 2.1 inch, .410 gauge Cheddite hulls (manually cut down from 2.5 inch hulls) were loaded with smokeless shotshell powder, 7.5 grains of 16/20 walnut media (which occupied roughly 0.4 inches in length inside the hull), and ½ ounce number 9 lead shot, then star-crimped and fired. A second series of roughly 2.1 inch, .410 gauge Cheddite hulls (manually cut down from 2.5 inch hulls) were loaded with smokeless shotshell powder, 6.6 grains of 16/20 corn cob media (which occupied roughly 0.45 inches in length inside the hull), and ½ ounce number 9 lead shot, then star-crimped and fired. Pressures and velocities were significantly lower and more variable than with the previous sets of shotshells which used 13 grains of walnut media or 10 grains of corn cob media, suggesting that with this particular load and these obturating media, the linear volume occupied by the particulate obturating media was less than the amount necessary to ensure proper gas sealing with the obturating media.

Example 19

A granular formulation of 20/30 walnut shell media comprising primarily particles between 595 microns and 840 microns in size was used as a particulate obturating medium. 2.75 inch, 12 gauge hulls were loaded sequentially with smokeless shotshell powder, 70 grains of 20/30 walnut media (corresponding to about 0.9 inches in linear volume in the hull), and one ounce of number 8.5 lead shot, then star-crimped and subjected to accelerated migration testing as described previously. During the accelerated migration testing, the walnut media migrated into pore spaces between the lead shot in significant amounts. This resulted in net migration of lead shot away from the distal end of the hull, creating a void space in the hull. Eventually, the smokeless powder also migrated.

Example 20

A granular formulation of 18/40 walnut shell media comprising primarily particles between 1000 microns and 420 microns in size was used as a particulate obturating medium. 2.75 inch, 12 gauge hulls were loaded with smokeless shotshell powder, 18/40 walnut media, and ⅞ ounce of number 8 lead shot. The walnut media and lead shot were mixed using the plunge technique described herein, then star-crimped. A series of such shells was fired and yielded pressures between 8,000 psi and 9,000 psi.

A granular formulation of 36/60 walnut shell media comprising primarily particles between 485 microns and 250 microns in size was used as a particulate obturating medium. 2.75 inch, 12 gauge hulls were loaded with smokeless shotshell powder, 36/60 walnut media, and ⅞ ounce of number 8 lead shot. The walnut media and lead shot were mixed using the plunge technique, then star-crimped. A series of such shells was fired and yielded pressures between 10,000 psi and 11,000 psi. In some cases, hulls were ripped into pieces due to the high pressure and friction from the smaller walnut media, although stronger, higher quality hulls might be less likely to rip when used.

In summary, for otherwise equivalent loads, the smaller walnut media tends to give better gas sealing, but also higher pressures that are more likely to result in damaged hulls or other issues.

Example 21

A granular formulation of 12/16 walnut shell media comprising primarily particles between 1,680 microns and 1,190 microns in size was used as a particulate obturating medium. 2.75 inch, 12 gauge hulls were loaded successively with 25 grains smokeless shotshell powder, 70 grains of 12/16 walnut media, and 1 ounce of number 7.5 lead shot, then crimped. The walnut media and lead shot were not intentionally pre-mixed, and the walnut media did not appreciably migrate into the shot layer during accelerated migration testing. A series of five such shells was fired. Four of the five shots yielded consistent pressure and velocity (averaging 1,298 fps), but the other shot has substantially lower pressure and a velocity of only 911 fps, indicative that this size of walnut media in this particular load did not form a consistently good gas seal.

Example 22

A granular formulation of 12/20 walnut shell media comprising primarily particles between 1,680 microns and 841 microns in size was used as a particulate obturating medium. 2.75 inch, 12 gauge hulls were loaded successively with smokeless shotshell powder, 70 grains of 12/14 walnut media, and 1 ounce of number 7.5 lead shot, then crimped. The walnut media and lead shot were not intentionally pre-mixed, and the walnut media did not appreciably migrate into the shot layer during accelerated migration testing. A series of five such shells was fired, yielding an average velocity of 1,315 fps with a standard deviation of 22 fps, and an average pressure of 10,225 psi, with a standard deviation of nearly 800 psi.

Example 23

A granular formulation of 16/20 walnut shell media comprising particles that passed through a 16 mesh filter and were retained on a 20 mesh filter, corresponding to sizes between 1,190 microns and 840 microns, was used as a particulate obturating medium. 2.75 inch, 12 gauge hulls were loaded successively with 26 grains of a smokeless shotshell powder, 70 grains of 16/20 walnut media, and 1 ounce of number 7.5 lead shot, then crimped. The walnut media and lead shot were not intentionally pre-mixed, and the walnut media did not significantly migrate into the shot layer. A series of five such shells was fired, with remarkably consistent velocities averaging 1,316 feet per second with a standard deviation of less than 7 fps, and consistent pressures averaging 10,040 psi with a standard deviation of less than 200 psi.

Example 24

A granular formulation of 16/20 walnut shell media comprising particles that passed through a 16 mesh filter and were retained on a 20 mesh filter, corresponding to sizes between 1,190 microns and 840 microns, was used as a particulate obturating medium. 2.75 inch, 12 gauge hulls were loaded successively with smokeless shotshell powder, 70 grains of 16/20 walnut media, and 1 ounce of lead shot before crimping. The following three sizes of lead shot were used: number 7.5, number 8, or number 9. The hulls were subjected to accelerated migration testing, and no significant migration was observed.

Example 25

A granular formulation of 16/20 walnut shell media comprising particles that passed through a 16 mesh filter and were retained on a 20 mesh filter, corresponding to sizes between 1,190 microns and 840 microns, was used as a particulate obturating medium. Ten 2.75 inch, 12 gauge hulls were loaded successively with smokeless shotshell powder, 70 grains of 16/20 walnut media, and 1 ounce of number 7.5 lead shot, then crimped. The walnut media and lead shot were not intentionally pre-mixed, and the walnut media did not significantly migrate into the shot layer. Half of the shotshells were exposed to environmental conditions (left outside for 48 hours), then shot in a Jul. morning in Georgia with 90% relative humidity. The other shotshells were placed in individual bags with a desiccant pack, and loaded into a closed container with additional desiccant, where they were kept for 48 hours before being removed from the dry environment and immediately fired before having time to equilibrate to the humid environment.

The dried shotshells were fired, and gave velocities averaging 1,353 fps with a standard deviation of less than 10 fps, and pressures averaging 10,600 psi with a standard deviation of less than 500 psi. The environmentally conditioned shotshells (i.e., at 90% humidity) were fired, yielding velocities averaging 1,334 fps with a standard deviation of less than 20 fps, and consistent pressures averaging 9,940 psi with a standard deviation of less than 600 psi.

Example 26

A granular formulation of 14/16 corn cob media comprising particles that passed through a 1,410 micron filter and were retained on a 1,190 micron filter was used as a particulate obturating medium. 2.75 inch, 12 gauge hulls were loaded successively with 27 grains smokeless shotshell powder, 55 grains of 14/16 corn cob media, and 1 ounce of number 7.5 lead shot, then crimped. The corn cob media and lead shot were not intentionally pre-mixed, and the corn cob media did not appreciably migrate into the shot layer during accelerated migration testing. A series of five such shells was fired, yielding velocities averaging 1,330 fps with a standard deviation of 34 fps, and pressures averaging 8,400 psi with a standard deviation of nearly 1,500 psi.

Example 27

A granular formulation of 16/20 corn cob media comprising particles that passed through a 1,190 micron (16 mesh) filter and were retained on an 841 micron (20 mesh) filter was used as a particulate obturating medium. 2.75 inch, 12 gauge hulls were loaded successively with 27 grains smokeless shotshell powder, 55 grains of 16/20 corn cob media, and 1 ounce of number 7.5 lead shot, then crimped. The corn cob media and lead shot were not intentionally pre-mixed, and the corn cob media did not appreciably migrate into the shot layer during accelerated migration testing. A series of five such shells was fired, yielding velocities averaging 1313 fps with a standard deviation of 13 fps, and pressures averaging 8125 psi with a standard deviation of approximately 350 psi.

Example 28

A granular formulation of 16/20 corn cob media comprising particles that passed through a 16 mesh filter and were retained on a 20 mesh filter, corresponding to sizes between about 1,190 microns and about 840 microns, was used as a particulate obturating medium. Ten 2.75 inch, Fiocchi 12 gauge hulls were loaded successively with smokeless shotshell powder, 60 grains of 16/20 corn cob media, and 1 ounce of number 7.5 lead shot, then crimped. The corn cob media and lead shot were not intentionally pre-mixed, and the corn cob media did not significantly migrate into the shot layer. Half of the shotshells were subjected to environmental conditioning at 99% relative humidity. The other shotshells were placed in individual bags with a desiccant pack, and loaded into a closed container with additional desiccant, where they were kept for 48 hours before being removed from the dry environment (19% relative humidity) and immediately fired before having sufficient time to equilibrate to the humid environment.

The dried shotshells were fired, and gave velocities averaging 1,300 fps and pressures averaging 8,460 psi with a standard deviation of 625 psi. The environmentally conditioned shotshells (i.e., at roughly 99% relative humidity) were fired, yielding velocities averaging 1,334 fps and pressures averaging 7780 psi with a standard deviation of 560 psi.

Example 29

A granular formulation of 16/20 corn cob media comprising particles that passed through a 16 mesh filter and were retained on a 20 mesh filter, corresponding to sizes between about 1,190 microns and about 840 microns, was used as a particulate obturating medium. 2.75 inch, 12 gauge hulls were loaded successively with smokeless shotshell powder, 60 grains of 16/20 corn cob media, and 1 ounce of number 7.5 lead shot, totaling 360 pellets, then crimped. The corn cob media and lead shot were not intentionally pre-mixed, and the corn cob media did not significantly migrate into the shot layer.

Three shots were fired with a full choke, yielding velocities of 1349, 1350, and 1359 feet per second. Pattern testing was performed with these three shots at 30 yards. Of the 360 pellets per load in the three loads, the number hitting within a 30 inch diameter circle averaged 350.67 pellets (over 97%), with a standard deviation of only 1.25 pellets. An average of 134 pellets landed within a ten inch diameter circle around the centerpoint, with a standard deviation of 10 pellets. An average of 292 pellets landed with a 20 inch diameter circle around the centerpoint, with a standard deviation of less than five pellets.

Example 30

Commercially available, 12 gauge shotshells that included a hard nitro card, a thick paper cup with roughly 0.63 inch internal diameter, and one ounce of steel shot were disassembled. The powder was reloaded into primed hulls, and the nitro cards were discarded. The paper cups were loaded on top of the powder, followed by obturating media and one ounce of #7 steel shot inside the paper cups. Some of the reloaded shells were loaded with 16/20 corn cob media (either 10 grains or 15 grains), and others were loaded with 16/20 walnut media (either 20 or 25 grains). The steel shot was simply loaded on top of the obturating media inside the thick paper cups, with no mixing. Note that the paper cups themselves (i.e., in the absence of a nitro card or obturating media) would not provide a suitable gas seal. The shotshells were fired, and the shotshells utilizing particulate obturating media fired well and had consistent pressures, with the corn cob media-loaded shells having lower pressures than the walnut media-loaded shells.

INCORPORATION BY REFERENCE

All publications, patents, and patent applications cited herein are hereby expressly incorporated by reference in their entirety and for all purposes to the same extent as if each was so individually denoted.

EQUIVALENTS

While specific embodiments of the subject invention have been discussed, the above specification is illustrative and not restrictive. Many variations of the invention will become apparent to those skilled in the art upon review of this specification. The full scope of the invention should be determined by reference to the claims, along with their full scope of equivalents, and the specification, along with such variations.

The articles "a" and "an" are used herein to refer to one or to more than one (i.e. to at least one) of the grammatical object of the article. By way of example, "a wad" means one wad or more than one wad.

Any ranges cited herein are inclusive.

What is claimed is:

1. A cartridge comprising:

a) a cartridge case having a proximal end and a distal end, and further comprising a primer situated at the proximal end;

b) a propellant, a portion of which is contiguous with the primer;

c) a particulate obturating medium distal to the propellant;

wherein said particulate obturating medium comprises discrete particles capable of independent movement and not physically bound to each other;

wherein said particles have an average specific gravity of greater than 1.1;

wherein said particles have an average size greater than 212 microns;

wherein said particulate obturating medium occupies at least 6 mm in length within the cartridge case;

wherein particles of said particulate obturating medium are within 5 mm of said propellant; and wherein said cartridge does not comprise a thermoplastic, molded wad that obturates to form a gas seal.

2. The cartridge of claim 1, wherein the majority of said particles comprising said particulate obturating medium have an irregular shape.

3. The cartridge of claim 1, further comprising a pre-formed wad and at least one projectile distal to the particulate obturating medium;

wherein said pre-formed wad has a general cup shape within said cartridge;

wherein said pre-formed wad comprises a cellulosic material;

wherein particles of said particulate obturating medium are contained within said pre-formed wad having a general cup shape; and wherein said cartridge is an ammunition cartridge.

4. The cartridge of claim 1, further comprising at least one projectile distal to the obturating medium.

5. The cartridge of claim 4, further comprising a granular buffering agent.

6. The cartridge of claim 4, wherein said projectile is a frangible projectile, a rubber projectile, a bean bag projectile, a tear gas-containing projectile, an oleoresin *capsicum*-containing projectile, a liquid-filled marking projectile, a tracer projectile, a penetrator projectile, a flechette projectile, an armor-piercing projectile, an incendiary projectile, a flare projectile, a chemical particulate-containing projectile, or any combination thereof.

7. The cartridge of claim 4, wherein the cartridge is an ammunition cartridge and wherein said at least one projectile comprises lead, steel, bismuth, tungsten, tin, iron, copper, zinc, aluminum, nickel, chromium, molybdenum, cobalt, manganese, antimony, alloys thereof, composites thereof, or any combinations thereof.

8. The cartridge of claim 7, wherein said at least one projectile has a velocity exceeding 1,000 feet per second when said cartridge is fired from a shotgun.

9. The cartridge of claim 7, further comprising at least five shot projectiles, and comprising a crimped section at the distal end of the cartridge, wherein said obturating medium is intermingled with said shot projectiles such that said obturating medium occupies a continuous layer between said propellant and said crimped section at the distal end of the cartridge.

10. The cartridge of claim 1, wherein said particles comprise a plant material comprising lignin.

11. The cartridge of claim 10, wherein said plant material comprises nut shells.

12. The cartridge of claim 11, wherein said plant material comprises walnut shells.

13. The cartridge of claim 10, wherein said plant material comprises corn cobs.

14. The cartridge of claim 1, wherein at least 90% by weight of said particles are retained on a 595 micron filter.

15. The cartridge of claim 1, wherein said particles have an average size greater than 840 microns, and wherein said particulate obturating medium occupies at least 7 mm in length within the cartridge case.

16. The cartridge of claim 1, wherein said cartridge is selected from the group consisting of an ammunition cartridge, a flare cartridge; a grenade launcher cartridge, a smoke flare cartridge, a signaling device cartridge, a chemical munitions cartridge; a distraction device cartridge, a fire suppressant cartridge, and a pyrotechnic launching device cartridge.

17. The cartridge of claim 1, wherein said particulate obturating medium comprises particles comprising a biodegradable polymer formulation.

18. The cartridge of claim 1, wherein at least 95% by weight of the particles in the obturating medium pass through a U.S. mesh size 12 filter and are retained on a U.S. mesh size 40 filter.

19. The cartridge of claim 1, wherein the cartridge is a shotshell, and wherein the average size of the particles in said obturating medium drops by at least a factor of two after said shotshell is fired from a shotgun at a speed exceeding 500 feet per second.

20. The cartridge of claim 1, wherein the ratio of the bulk density of the particulate obturating medium to the average specific gravity of the particles comprising the particulate obturating medium is less than 0.8 $g/cm^3$.

21. The cartridge of claim 1, wherein said particles of said obturating medium comprise shell fragments from animal shells.

22. The cartridge of claim 1, further comprising a flexible container situated between said propellant and said particulate obturating medium, wherein said particulate obturating medium is at least partially contained within said flexible container.

* * * * *